US005765082A

United States Patent [19]

Numazu et al.

[11] Patent Number: 5,765,082

[45] Date of Patent: Jun. 9, 1998

[54] COLOR IMAGE FORMING APPARATUS HAVING SHIFTABLE TRANSFER CONVEYOR BELT AND ATTRACTION ASSISTING ROLLER

[75] Inventors: Toshihiko Numazu, Sayama; Kazuyoshi Hagiwara, Tokorozawa; Tetsuya Abe, Tama, all of Japan

[73] Assignee: Casio Computer Co., Ltd., Tokyo, Japan

[21] Appl. No.: 751,814

[22] Filed: Nov. 19, 1996

[30] Foreign Application Priority Data

Nov. 20, 1995 [JP] Japan ..... 7-300883
Dec. 1, 1995 [JP] Japan ..... 7-314388

[51] Int. Cl.[6] ..... G03G 15/01

[52] U.S. Cl. ..... 399/299

[58] Field of Search ..... 399/299, 303, 399/312, 317, 316

[56] References Cited

U.S. PATENT DOCUMENTS 5,119,139 6/1992 Torisawa .
5,172,175 12/1992 Sekino et al. ..... 399/299
5,303,018 4/1994 Terada et al. ..... 399/299
5,321,477 6/1994 Nagata et al. ..... 399/312
5,365,324 11/1994 Gu et al. ..... 399/299
5,602,633 2/1997 Yoshida et al. ..... 399/244

FOREIGN PATENT DOCUMENTS 5-229686 9/1993 Japan .
7-199590 8/1995 Japan .

*Primary Examiner*—Robert Beatty
*Attorney, Agent, or Firm*—Frishauf, Holtz, Goodman, Langer & Chick

[57] ABSTRACT

An image forming apparatus includes a plurality of image carriers arranged side by side along the outer surface of a conveying portion of a transfer belt. The transfer belt is stretched between a first upstream roller and a second downstream roller. An image forming medium is conveyed on the belt so as to have multiple color images transferred thereto. The transfer belt has a swing lever so as to move the belt between a horizontal full color position and an inclined monochrome position. A stationary support roller which is arranged within the transfer belt and at a position nearer to the second downstream roller maintains a position of the image forming medium constant even when a monochrome image is being transferred. In addition, an electrostatic attraction roller located outside the transfer belt is arranged at a specific angle relative to the first roller to assist in the attraction of the image forming medium to the transfer belt.

17 Claims, 9 Drawing Sheets

COLOR IMAGE FORMING APPARATUS HAVING SHIFTABLE TRANSFER CONVEYOR BELT AND ATTRACTION ASSISTING ROLLER

BACKGROUND OF THE INVENTION

1. Field of the Invention

This invention relates to an image forming apparatus for attracting a paper sheet on the outer peripheral surface of a conveyor belt, conveying the paper sheet by the belt and forming an image on the sheet, and more particularly to a tandem type image forming apparatus suitable for downsizing, capable of easily selecting the printing mode between monochrome printing mode and multi-color printing mode, while keeping reliable conveyance of a paper sheet by stable attraction of the sheet without changing the attitude of the sheet during its conveyance.

2. Description of the Related Art

Various types of conventional image forming apparatuses such as printers and copy machines, etc., have been widely known. Recently, full-colored image forming has been required and apparatuses for performing full-color image forming has been put to practice. Such color image forming apparatuses can be roughly classified into single-drum type ones and multi-drum (tandem) type ones. In the single-drum type apparatus, four kinds of toners, i.e. Y (yellow) toner, M (Magenta, i.e. red) toner and C (cyanogen, i.e. blue inclining to green) toner (these three colors are the three primary colors), and Bk (black) toner only for characters, etc. are transferred to one paper sheet, and these transformations are performed in four printing (image forming) processes which are different from each other. In other words, in order to print a color image on a single sheet, the printing processes must be repeated four times so that a great amount of time is required. In contrast to this, in the tandem type apparatuses, the four kinds of toners are sequentially transferred to one paper sheet in one process. Alternatively, at first the four kinds of toners are sequentially transferred to an intermediate transfer member, and then the intermediate transfer member further transfers the once transferred toners to a paper sheet at one time. Accordingly, image forming speed in the tandem type apparatus is four times faster than that in the single-drum type apparatus. Further, internal devices incorporated in the image forming apparatus have come to be made compact and constructed as units, and hence the manufacturing cost of the tandem type apparatus have come to be lowered. As a result of this, various tandem type color image forming apparatuses are now being proposed.

FIG. 7A shows an outer appearance of a conventional small-sized tandem type color image forming apparatus, and FIG. 7B is a schematical longitudinal sectional view of the apparatus in FIG. 7A. As is shown in FIG. 7A, the conventional tandem type color image forming apparatus has an openable tray 2 at a front surface (a right end surface in FIG. 7A) of an apparatus body 1, and a detachable sheet cassette 3 at a lower portion of the body 1. Further, a sheet discharge tray 5 is formed on a top cover 4 of the body 1, and an image-formed paper sheet discharged from an upper sheet discharge port 6 is laid on the discharge tray 5. On one side of a front end portion of the top cover 4, a power switch 7, a liquid crystal display 8, a plurality of input keys 9, etc. are arranged.

To perform image forming, as shown in FIG. 7B, a paper sheet P contained in the sheet cassette 3 in the body 1 is fed by a feed roller 11 to a standby section located above the cassette 3. To perform image forming on a sheet which is different from the sheet in the cassette 3, the openable tray 2 is opened as indicated by the arrow A, and then an auxiliary tray **2*b* folded within the openable tray 2 is rotated as indicated by the arrow B to extend forward from the openable tray 2. The different sheet placed on the openable tray 2 and the auxiliary tray 2*b* is fed to the standby section by a feed roller 12. A pair of standby rollers 13 are provided in the standby section, and the standby rollers 13 temporarily stop the sheet fed from the sheet cassette 3 or from the openable and auxiliary trays 2 and 2*b***, then start the supply of the sheet to an image forming section along a conveying path indicated by the broken line at a predetermined timing for an image forming.

In the image forming section, a conveyor belt 14 for conveying a sheet is stretched between two rollers **15*a* and 15*b* and four image forming units 16-1, 16-2, 16-3, 16-4 are arranged along the belt 14. The belt 14 circulates counter-clockwise as indicated by the arrows C and D. Each of the image forming units 16-1, 16-2, 16-3, 16-4 is structured by assembling an electric charger, an exposing head, developing rollers, an image transfer, a cleaner, etc. in a unit frame. These image forming units 16-1, 16-2, 16-3, 16-4 are arranged in line in a conveying direction of the belt 14. When the image forming units 16-1, 16-2, 16-3, 16-4 are mounted in the apparatus body 1 as shown in FIG. 7B, each of the units 16-1, 16-2, 16-3, 16-4 is combined with a photosensitive drum 17 to arrange the above described structural members thereof around the photosensitive drum 17. In a downstream of the sheet conveying path of the image forming section, a fixing unit 18, a pair of sheet discharge rollers 19 and a rear discharge port 21** are provided.

In the image forming section, toner images of different colors are respectively transferred from the four photosensitive drums 17 to the sheet fed thereto, and then the toner images transferred to the sheet is fixed thereon by the fixing unit 18. The sheet with the fixed toner images is discharged by the paired discharge rollers 19 from the body 1 to the outside of the body 1 through the rear discharge port 21, as is indicated by the arrow E. Alternatively, after the sheet discharge path is changed upward by operation of a sheet-discharge-path change lever (not shown), the sheet can be discharged from the body 1 to the discharge tray 5 on the top cover 4 by a pair of sheet discharge rollers 22, as is indicated by the arrow F.

For an usual resolution, the density of printing (image forming) pixels is set to 300–400 dots per 1 inch (i.e. 12–16 dots per 1 mm). However, if each of the toner images of the four colors is displaced even by 1 dot from its correct position, moire fringe patterns will occur in the final image, thereby greatly degrading the quality of the final image. To avoid this, it is necessary to keep each sheet stably held on the belt 14 while the sheet is conveyed by the belt 14 and the toner images of different colors are transferred from the four photosensitive drums 17 to the sheet.

Full-color printing is not always needed. In general, printing in black (hereinafter referred to "monochrome printing") is often performed. In the light of this, such an image forming apparatus is now being proposed, in which a conveying path for color printing and that for monochrome printing are provided for enabling to switch between a color printing mode and a monochrome printing mode. The two conveying paths inevitably complicate a conveying mechanism and hence make the size of the mechanism being large, resulting in an increase in manufacturing cost. Moreover, since it is very difficult to control the apparatus so as to use only one of the two conveying paths or to simultaneously use the two paths, the structure for controlling the apparatus is complicated so that labor for maintenance of the structure is great.

A structure for avoiding the above problems is disclosed in Japanese Patent Application KOKAI Publication No. 7-199590, for example. In this conventional structure, a sheet press roller to which a bias is applied, is provided on a conveyor belt (similar to the belt 14 in FIG. 7B) at the upstream end thereof with the sheet press roller being arranged at the upstream side of the corresponding belt drive roller 24 in the sheet-conveyance direction. Further in this apparatus, the belt is inclined downward around its upstream end portion by 10 degrees to thereby partially separate the conveying surface region of the belt from the image forming units or photosensitive drums when the monochrome printing is performed.

FIGS. 8A and 8B schematically show a main portion of the conventional structure. As is shown in FIG. 8A, the conventional structure has an insulating conveyor belt 26 stretched between two drive rollers 23 and 24 with a tension roller 25 such that the belt 26 circulates counterclockwise as indicated by the arrows E and F. The conveyor belt 26 can be vertically moved around the downstream-side roller 23 between a horizontal position shown in FIG. 8A and an inclined position shown in FIG. 8B. A sheet press roller 32 is in contact with the upstream-side roller 24 with a line 35 connecting the rotational centers of the rollers 24 and 32 being inclined at 60–80 degrees toward the upstream side of a paper conveying path on the belt 26 to the horizontal line 36, as is shown in FIG. 8A. A bias for sheet attachment is applied to the sheet press roller 32 from a bias source 37. By this structure, a paper sheet P can reliably be attached to the conveyor belt 26.

When the full color printing is performed, the conveyor belt 26 is arranged in the horizontal position and conveys the paper sheet P to make the sheet P being in contact with the photosensitive drums 27*a*, 27*b*, 27*c* and 27*d* of the four image forming units, as is shown in FIG. 8A. The photosensitive drums 27*a*, 27*b*, 27*c* and 27*d* carry toner images of Y (yellow), M (Magenta), C (cyanogen) and Bk (black), respectively. The paper sheet P is fed from a sheet cassette 28 by a sheet feed roller 29, introduced into an image forming section at a predetermined timing for image forming on the sheet P in the image forming section, and attached on the conveyor belt 26 by the sheet press roller 32. Thereafter, the toner images formed on the photosensitive drums 27*a*, 27*b*, 27*c* and 27*d* are sequentially transferred to the sheet P by corona chargers 33*a*, 33*b*, 33*c* and 33*d*, respectively, such that the toner images overlap each other on the sheet. Finally, the overlapping toner images are thermally fixed to the sheet by a fixing unit 34.

When the monochrome printing is performed, the conveyor belt 26 is inclined to the inclined position shown in FIG. 8B, in which the belt 26 is in contact only with the photosensitive drum 27*d* which carries Bk (black) toner image, and is separated from the other drums 27*a*, 27*b* and 27*c*. Thus, the both monochrome printing and full color printing can be performed with only one single sheet conveying path being used.

However, in the above conventional structure, since the sheet press roller 32 is arranged on the inclined line 35 being inclined toward the upstream side of the conveying path on the conveyor belt 26 with respect to the upstream-side roller 24, magnitude of an electric field applied to the belt 26 is increased, but the paper sheet P is lead in a direction in which the sheet P is separated from the conveyor belt 26 due to its rigidity.

FIGS. 9A and 9B are enlarged views of an upstream side of the image forming section in FIGS. 8A and 8B, respectively. As is shown in FIG. 9A, since the line (i.e. the broken line 35) passing through the centers of the rollers 24 and 32 inclines at 60–80 degrees toward the upstream side of the conveying path on the conveying belt 26 with respect to the horizontal line 36, a direction indicated by a broken line 38 in which the sheet is discharged from the contact point (paper holding point) between the rollers 24 and 32 toward the image forming section (i.e. to the left in FIG. 9A) is perpendicular to the line (i.e. the broken line 35) passing through the rotation centers of the rollers 24 and 32, and extends upward and leftward. Thus, although the bias is applied to the conveyor belt 26 in a direction to more strongly attract the sheet on the conveyor belt 26, the sheet is inevitably discharged from the contact point between the rollers 32, 24 in the direction indicated by the broken line 38, so that the sheet is separated from the belt 26 against the paper attracting force generated by the bias and the sheet is conveyed in an unstable floating state as is indicated by the broken line 39.

When the sheet is introduced into the image transfer section with the sheet being not attached enough on the conveyor belt 26, deflection of the printing position may be caused, or catching of leading end of the sheet by some portions of the apparatus may be caused to produce sheet jam in the apparatus. The same situation is produced in a case where the conveyor belt 26 is inclined with its upstream end being moved downward to perform the monochrome printing. In this case, since the conveying distance of the sheet from the contact point between the upstream-side rollers 24 and 32 to the black toner image transfer position is long, the sheet floating as indicated by the broken line 39' in FIG. 9B becomes more unstable, the deflection of the printing position becomes more large, and the sheet jam may more easily occur.

To avoid the unstable conveyance of the sheet on the conveyor belt, the above-described apparatus uses a dielectric belt as the conveyor belt to increase the attraction of the sheet. Moreover, the apparatus uses a corona discharger as the image transfer unit to obtain sufficient image transfer results irrespective of changes in ambient condition around the apparatus caused by the dielectric conveyor belt.

However, the corona discharger requires a relatively great amount of electric current, and inevitably requires a power supply of a large size. In addition, when the printing speed is increased, the amount of ozone resulting from corona discharge increases. In this case, a device for treating a great amount of ozone is necessary, and accordingly the entire apparatus must have a larger size and the manufacturing cost of the apparatus increases. Further, since the sheet attracting force produced by the deelectric belt is strong, a particular deelectrifying device is necessary for deelectrifying the deelectric belt and an image-formed sheet to separate the image-formed sheet from the belt. As a result, the entire apparatus becomes inevitably much larger and the manufacturing cost becomes inevitably more increases.

The Japanese Patent Application KOKAI Publication No. 7-199590 proposes a structure for avoiding the deflection of the printing position and the sheet jam in the monochrome printing, as is shown in FIG. 8C of the application. In this structure, the downstream side roller 23 can be moved downward to incline the conveyor belt 26, and the location of the image forming unit (the photosensitive drum 27*d*) for black toner, which is located in the downstream end position in FIGS. 8A and 8B, is changed with the image forming unit (the photosensitive drum 27*a*) for Y (yellow) toner, which is located in the upstream end position in FIG. 8C, thereby enabling switching between the monochrome printing and the full color printing with the paper introducing path from the contact point between the upstream side roller 24 and the paper press roller 32 toward the image form section being kept constant.

In this structure, however, a paper conveying path cannot be stable between the entrance of the image forming section and the fixing section 34.

Furthermore, both in the structure where the upstream side roller 24 is moved downward to incline the belt 26 as shown in FIG. 8B and in the structure where the downstream side roller 23 is moved downward to incline the belt as shown in FIG. 8C, the inclined conveyor belt 26 is brought into contact with the photosensitive drum **27*d* with black toner when the monochrome printing mode is set. Accordingly, the toner image transfer position on the photosensitive drum 27*d* differs in the monochrome printing and in the full color printing in which the conveyor belt 26 contacts the drum 27*d* in the horizontal state, so that the direction in which the corona charger acts on the photosensitive drum 27*d*** differs therebetween. As a result, stable black image forming cannot be performed.

SUMMARY OF THE INVENTION

The invention has been derived from the above-described circumstances, and an object of the invention is to provide a tandem type image forming apparatus of a compact size, in which an image transferred medium such as a paper sheet can be conveyed stably, ozone gas will not be produced, and deelectrifying of a sheet conveyor belt can be performed easily. Another object of this invention is to provide a tandem type image forming apparatus in which a single sheet conveying path is employed, the printing mode between monochrome printing and multicolor printing can be switched easily, both a sheet introducing path from a sheet feed section to an entrance of an image forming section and a sheet conveying path from the entrance of the image forming section to a fixing section can be kept constant, and the attitude of the image transferred medium at an image transfer position on a black toner image carrier can be kept constant.

According to a first aspect of the invention, an image forming apparatus comprises a plurality of image carriers arranged side by side; a plurality of toner image forming means for forming toner images of predetermined different colors on the image carriers, respectively; a conveyor belt for attracting an image transferred medium on an outer surface thereof and circulating to bring the image transferred medium into contact with at least one of the image carriers; a plurality of image transfer means arranged in a space being encircled by the conveyor belt, opposing to the image carriers to structure image forming portions, and being applied with transfer bias to transfer the toner images from the image carriers to the transferred medium which contacts the image carriers; first and second drive rollers located at outsides of the two outer image transfer portions in a direction in which the plurality of image transfer portions are arranged, and stretching the conveyor belt between them; and an attachment assisting roller arranged to press the first drive roller with the conveyor belt interposed therebetween, thereby to hold the image transferred medium therebetween and forward the image transferred medium so as to assist the attachment of the image transferred medium on the conveyor belt.

The attachment assisting roller is arranged such that a line passing a rotation center of the attachment assisting roller and a rotation center of the first drive roller always intersects at an angle less than 90° with a line produced by a portion of the conveyor belt which extends toward the second drive roller from a contact point between the attachment assisting roller and the first drive roller.

In the image forming apparatus characterized by the above described structure, it is preferable that the apparatus further comprises attachment bias application means for applying an attachment bias on the attachment assisting roller. More preferably, the attachment bias application means applies on the attachment assisting roller a voltage of the same polarity as the polarity of the image transfer bias.

In the image forming apparatus characterized by the above described structure, it is further preferable that the apparatus further comprises belt moving means for holding the conveyor belt in a constant image transferable position at a location corresponding to that one of the image carriers which is closest to the second drive roller, so that the image transferred medium can be brought into contact with that image carrier always in the same attitude, and for moving the conveyor belt at locations corresponding to the remaining other image carriers between an image transferable position in which the toner images on the remaining other image carriers can be transferred to the image transferred medium and an image untransferable position in which the conveyor belt is moved away from the remaining other image carriers so that the image transferred medium can not be in contact with the remaining other image carriers and can not be transferred with toner images from the remaining other image carriers; and control means for controlling selectively movement of the belt moving means. In this case, the range of movement of the belt and the arrangement of the attachment assisting roller is so set that a line passing a rotation center of the attachment assisting roller and a rotation center of the first drive roller intersects at an angle less than 90° with a line produced by a portion of the conveyor belt which extends toward the second drive roller from a contact point between the attachment assisting roller and the first drive roller, irrespective of the movement of the belt moving means. Preferably, the attachment bias application means applies the attachment bias on the attachment assisting roller when the belt moving means moves the conveyor belt to the image untransferable position.

In the image forming apparatus characterized by the above described structure, that one of the toner image forming means which corresponds to the image carrier closest to the second drive roller forms a black toner image, and the other toner image forming means corresponding to the other image carriers form color toner images. Moreover, the first and second drive rollers rotate to move the conveyor belt so that the toner images can be transferred to the image transferred medium while the image transferred medium is conveyed from the first drive roller to the second drive roller.

According to a second aspect of the invention, an image forming apparatus comprises a plurality of image carriers arranged side by side; a plurality of toner image forming means for forming toner images of predetermined different colors on the image carriers, respectively; a conveyor belt for attracting an image transferred medium on an outer surface thereof and circulating to bring the image transferred medium into contact with at least one of the image carriers; a plurality of image transfer means arranged in a space being encircled by the conveyor belt, opposing to the image carriers to structure image forming portions, and transferring the toner images from the image carriers to the transferred medium which contacts the image carriers; first and second drive rollers located at outsides of the two outer image transfer portions in a direction in which the plurality of image transfer portions are arranged, and stretching the conveyor belt between them; belt moving means holding the conveyor belt in an image transferable position at a location corresponding to that one of the image carriers which is closest to the second drive roller, so that the image transferred medium can be brought into contact with that image carrier always in the same attitude, the belt moving means moving the conveyor belt to the image transferable position at locations corresponding to the other image carriers, so that the conveyor belt is in contact with the other image carriers and the image transferred medium is in contact with the other image carriers, or to an image untransferable position at locations corresponding to the other image carriers, so that the conveyor belt is separated from the other image carriers and the image transferred medium is not in contact with the other image carriers, the belt moving means including a stationary support roller which is located in the vicinity of that end of the image transfer means closest to the second drive roller, which is closer to the first drive roller than the other end of that image transfer means, and is in contact with the inner peripheral surface of the conveyor belt to make the conveyor belt always being in contact with the image carrier closest to the second drive roller, the belt moving means further including a swing member which is swingable around the rotational center of the stationary support roller to move the conveyor belt between the image transferable position and the image untransferable position with respect to the other image carriers; and control means for controlling selectively movement of the belt moving means.

In the image forming apparatus according to this invention and characterized by being structured as described above, it is preferable that the swing member includes a movable support roller provided at a free end side thereof between the first drive roller and that one of the image transfer means which is closest to the first drive roller, and contacting the inner peripheral surface of the conveyor belt, the movable support roller moving the conveyor belt in a direction intersecting the surface of the conveyor belt. Further, it is preferable that the swing member is integrally structured with the image transfer means other than the image transfer means, which is closest to the second drive roller.

The image forming apparatus according to the second aspect of the invention further comprises roller support means for supporting the first and second drive rollers to fix the positions of the drive rollers to the body of the apparatus. In addition, that one of the toner image forming means which corresponds to the image carrier closest to the second drive roller forms a black toner image, and the other toner image forming means corresponding to the other image carriers form color toner images. Further, the first and second drive rollers rotate to move the conveyor belt so that the toner images can be transferred to the image transferred medium while the image transferred medium is conveyed from the first drive roller to the second drive roller.

According to a third aspect of the invention, an image forming apparatus comprises: a plurality of image carriers arranged side by side; a plurality of toner image forming means for forming toner images of predetermined different colors on the image carriers, respectively; a conveyor belt for attracting an image transferred medium on an outer surface thereof and circulating to bring the image transferred medium into contact with at least one of the image carriers; a plurality of image transfer means arranged in a space being encircled by the conveyor belt, opposing to the image carriers to structure image transfer portions, and transferring the toner images from the image carriers to the medium while the medium is in contact with the image carriers; first and second drive rollers located at outsides of the two outer image transfer portions in a direction in which the plurality of image transfer portions are arranged, and stretching the conveyor belt between them; roller support means for supporting the first and second drive rollers to fix the positions of the drive rollers to the body of the apparatus; belt moving means holding the conveyor belt in an image transferable position at a location corresponding to that one of the image carriers which is closest to the second drive roller, so that the image transferred medium can be brought into contact with that image carrier always in the same attitude, the belt moving means moving the conveyor belt to an image transferable position at locations corresponding to the other image carriers, so that the conveyor belt is in contact with the other image carriers and the image transferred medium is in contact with the other image carriers, or to an image untransferable position at locations corresponding to the other image carriers, so that the conveyor belt is separated from the other image carriers and the image transferred medium is not in contact with the other image carriers; and control means for controlling selectively movement of the belt moving means.

In the image forming apparatus characterized by being structured as described above, the belt moving means includes a stationary support roller which is located in the vicinity of that end of the image transfer means closest to the second drive roller, which is closer to the first drive roller than the other end of that image transfer means, and is in contact with that inner peripheral surface of the conveyor belt to make the conveyor belt always being in contact with the image carrier closest to the second drive roller, the belt moving means further including a swing member which is swingable around the rotational center of the stationary support roller to move the conveyor belt between the image transferable position and the image untransferable position with respect to the other image carriers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The embodiments and modification of the invention will be described with reference to the accompanying drawings.

Figure 1A:
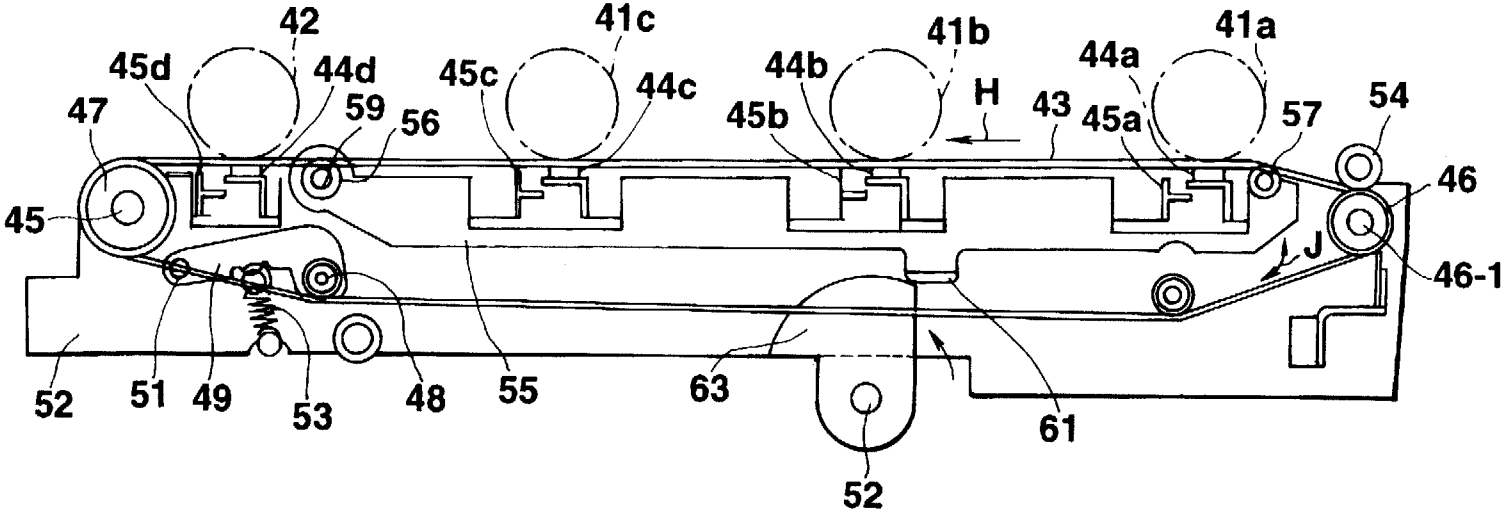
FIG. 1A is a schematic side view of a structure of a main part (image forming section) of an image forming apparatus according to an embodiment of the invention in a state for a full color printing.
Figure 1B:
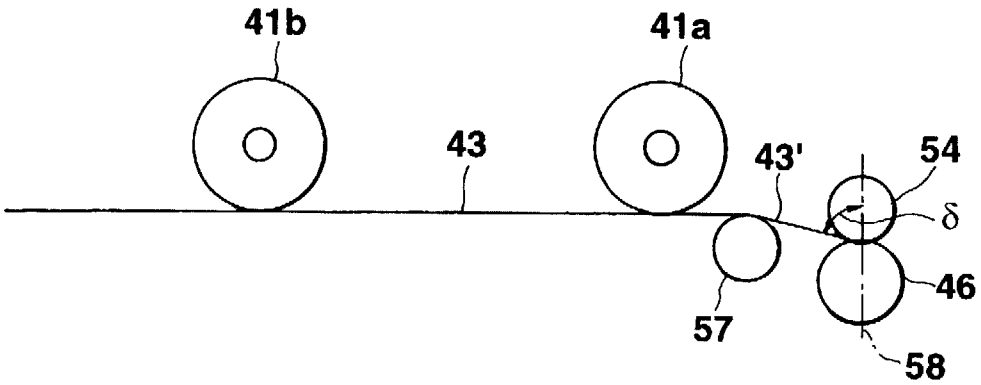
FIG. 1B is a schematical enlarged side view of a paper sheet introducing mechanism used in the apparatus of FIG. 1A.

FIG. 1A is a schematic side view of a structure of a main part (image forming section) of an image forming apparatus according to an embodiment of the invention in a state for a full color printing, and FIG. 1B is a schematical enlarged side view of a paper sheet introducing mechanism used in the apparatus of FIG. 1A.

Figure 2A:
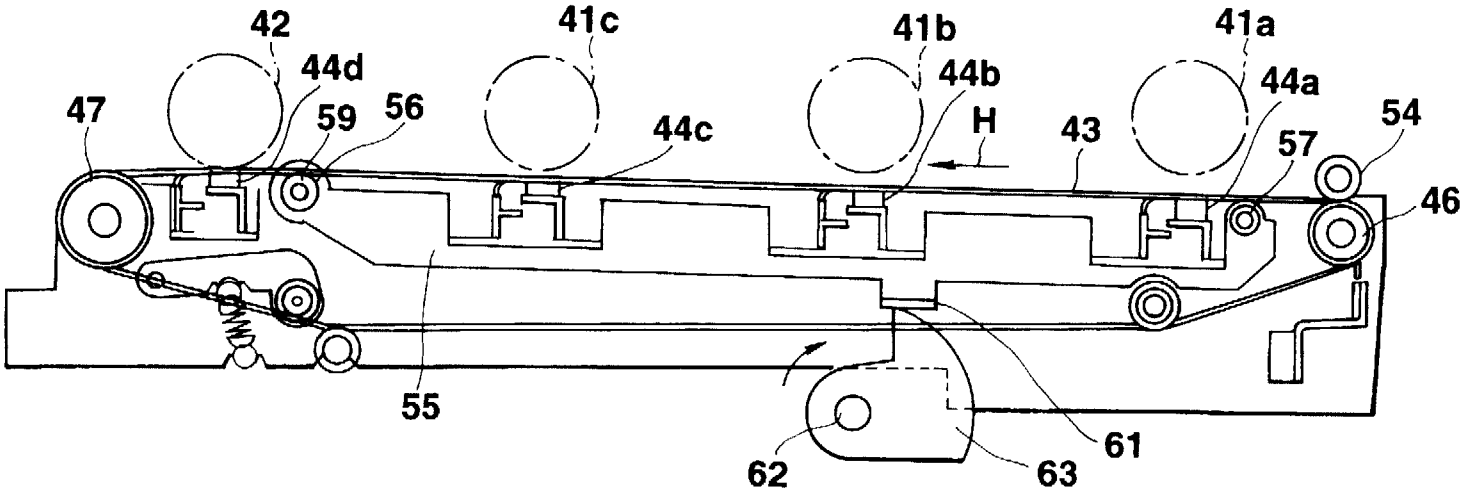
FIG. 2A is a schematic side view of the structure of the main part (image forming section) of the image forming apparatus according to the embodiment of the invention in a state for a monochrome printing.
Figure 2B:
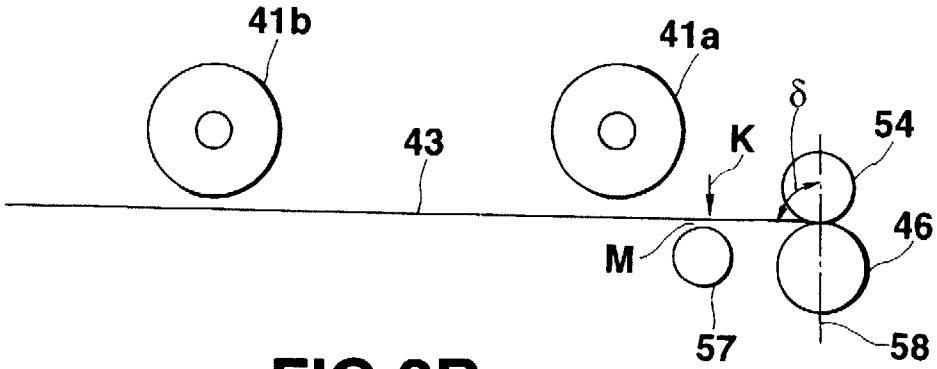
FIG. 2B is a schematical enlarged side view of the paper sheet introducing mechanism in the image forming apparatus of FIG. 2A.

Further, FIG. 2A is a schematic side view of the structure of the main part (image forming section) of the image forming apparatus according to the embodiment of the invention in a state for a monochrome printing, and FIG. 2B is a schematical enlarged side view of the paper sheet introducing mechanism in the image forming apparatus of FIG. 2A.

As is shown in FIG. 1A and FIG. 2A, the image forming section has four photosensitive drums (image carriers) 41*a*, 41*b*, 41*c* and 42 (each drawn by the one-dot chain line) arranged side by side in one direction, each of which will be described in detail later. Each of the photosensitive drums 41*a*, 41*b*, 41*c* and 42 is formed of a metal roller coated with an organic photoconductor (e.g. an OPC) or an inorganic photoconductor (e.g. Se, a-Si, etc.). These drums are rotated with their respective toner images of predetermined colors which are developed from electrostatic latent images carried thereon.

A conveyor belt 43 is arranged to oppose to the photosensitive drums 41*a*, 41*b*, 41*c* and 42 and circulates in a direction indicated by an arrow H, along which the drums 41*a*, 41*b*, 41*c* and 42 are arranged. The conveyor belt 43 is a film member made by adding carbon black to a fluororesin (tetrafluoroethylene copolymer (ETFE)) to adjust its resistivity, and has a thickness of 150 μm and a volume resistivity of $10^{11}$ to $10^{14}$ Ωcm. The conveyor belt 43 forms a horizontally flattened loop, attracts a paper sheet (image transferred medium) on the outer peripheral surface of its upper horizontally extending portion and to make the sheet being in contact with at least one of the photosensitive drums 41*a*, 41*b*, 41*c* and 42, i.e. the drum 42 in the embodiment, or in contact with all of the drums 41*a*, 41*b*, 41*c* and 42. Thus, the sheet is conveyed to an image transfer section by the conveyor belt 43, and at least one toner image on the photosensitive drums 41*a*, 41*b*, 41*c* and 42 is transferred to the sheet. If the volume resistivity of the conveyor belt 43 is lower than $10^{11}$ Ωcm, it is difficult to electrostatically attract the paper sheet thereon. This seems because electricity cannot keep staying on the inner peripheral surface of the belt 43.

Image transfer brushes 44*a*, 44*b*, 44*c* and 44*d* are provided in a space encircled by the belt 43 to contact those portions of the conveyor belt 43 which correspond to the four photosensitive drums 41*a*, 41*b*, 41*c* and 42, respectively. Each of the brushes (image transfer means) 44*a*, 44*b*, 44*c* and 44*d* is formed by attaching a brush-like cloth on a base of a metal or a plastic, the cloth being formed by weaving an electrically conductive fiber such as rayon, nylon or acryl, in a pile shape. These brushes 44*a*, 44*b*, 44*c* and 44*d* are connected to an electric power supply (not shown) for image transfer, which outputs a constant positive current. It is found from experiments that a current of several μA is usually sufficient as the current supplied to the image transfer brushes 44, although it depends upon the paper conveying speed or the width of the conveyor belt 43. These image transfer brushes 44 are opposed to the photosensitive drums 41*a*, 41*b*, 41*c* and 42 with the conveyor belt 43 interposed therebetween, thereby forming image transfer portions. The aforementioned positive electricity is applied to a sheet by these brushes 44 via the conveyor belt 43. An electric field caused by the applied electricity makes a toner image of a negative polarity being transferred from the photosensitive drum 41*a*, 41*b*, 41*c* or 42 to the sheet which is in contact therewith.

Since the conveyor belt 43 has a resistivity of semiconductivity and the image transfer brushes 44 which contact the conveyor belt 43 are provided as image transfer chargers, an image transfer load resistance is lower than a resistance between the bases of the brushes 44 and their earth even when the latter resistance is reduced in a high humidity state, so that an image transfer current flows toward the paper sheet and hence a sufficient image transfer electric field is obtained. Accordingly, the image forming apparatus can be used in any state, even in a dry state or in a high humidity state.

Deelectrifying brushes 45*a*, 45*b*, 45*c* and 45*d* are provided in the vicinity of the image transfer brushes 44*a*, 44*b*, 44c and 44d at the downstream sides thereof. These deelectrifying brushes 45a, 45b, 45c and 45d deelectrify the electricity applied to the conveyor belt 43 at the respective image transfer portions, thereby to stabilize the image transfer potential in each of the image transfer portions as in the first image transfer portion.

Outsides of the both outer image transfer portions in the direction along which the image transfer portions are arranged, a driven roller (a first drive roller) 46 is provided at the upstream end (at the right end in FIG. 1) of the belt 43 and a driving roller (a second drive roller) 47 is provided at the downstream end (at the left end in FIG. 1) of the belt 43, with respect to the sheet-conveying direction. On these rollers 46 and 47, the horizontally flattened conveyor belt 43 are hanged. These driven and driving rollers 46 and 47 are secured to a frame 52 of the apparatus by means of supporting shafts (roller support means) 46-1 and 45. These rollers 46 and 47 rotate counterclockwise. In this structure, a toner image is (or toner images are) transferred to a paper sheet (an image transferred medium) P while the conveyor belt 43 circulates and the sheet is conveyed from the driven roller 46 (the first drive roller) to the driving roller 47 (the second drive roller).

A tension roller (belt tension means) 48 is provided in the space encircled by the belt 43 in the vicinity of the driving roller 47, and contact the inner peripheral surface of the lower horizontally extending portion of the conveyor belt 43. More specifically, the tension roller 48 is rotatably attached to a free end of a key-shaped arm 49 a base end of which is rotatably supported by the frame 52 through a supporting shaft 51. A pull spring 53 is connected to a center portion of the arm 49 and the frame 52, and downwardly urges the arm 49. Accordingly, the tension roller 48 always downwardly urges the lower horizontally extending portion of the loop of the conveyor belt 43, thereby preventing the conveyor belt 43 from loosening and stretching the belt 43 between the driven and driving rollers 46 and 47 with a predetermined tension.

A movable arm (a swing member) 55 is provided between the upper horizontally extending portion and the lower horizontally extending portion of the loop of the conveyor belt 43, and extends in a direction parallel to the direction of conveyance of the paper. The movable arm 55 has a stationary support roller 56 at one end thereof, and a movable support roller 57 at the other end.

The stationary support roller 56 is rotatably supported by a supporting shaft 59 secured to the frame 52 of the apparatus. The stationary support roller 56 is located in the vicinity of that end of the image transfer brush (image transfer means) 44d closest to the driving roller 47, which is closer to the driven roller 46 than the other end of the brush. The stationary support roller 56 contacts the inner peripheral surface of the conveyor belt 43 such that the conveyor belt 43 always contacts the photosensitive drum (image carrier) 42 closet to the driving roller 47. As a result of this, the conveyor belt 43 is kept in an image transfer position so that the sheet (the image transferred medium) can always be brought into contact with the photosensitive drum 42 with the same attitude.

The movable arm 55 has the aforementioned movable support roller 57 at its free end, and the roller 57 contacts the inner peripheral surface of the conveyor belt 43 between the driven roller (the first drive roller) 46 and the image transfer brush (image transfer means) 44a closest to the driven roller 46, thereby supporting the belt 43.

The movable arm 55 is vertically rotatable (swingable) around the supporting shaft 59 as indicated by a bi-directional arrow J in FIG. 1A (i.e. the arm 55 can swing in a direction which intersects the upper and lower horizontally extending portions of the conveyor belt 43), thereby moving the conveyor belt 43 via the movable support roller 57. The movable arm 55, the stationary support roller 56 and the movable support roller 57 constitute belt moving means. The three image transfer brushes 44a, 44b and 44c other than the brush 44d are integrally attached to the movable arm 55, and are vertically moved by the swing of the movable arm 55 relative to the conveyor belt 43.

A cam engagement portion 61 projects sideward from a lower portion of the movable arm 55, and a cam (control means) 63 slidably contacts the cam engagement portion 61. The cam 63 can rotate through 90° around a support point 62 in opposite directions and selectively moves the movable arm 55 in the vertical direction.

In FIG. 1A, the cam 63 is located in a counterclockwise rotated position. At this time, the contact point of the cam 63 which contacts the cam engagement portion 61 is farthest from the support point 62, and the movable arm 55 is raised by the cam 63 and located in an upper position. In the upper position, the movable arm 55 makes, by mean of the movable support roller 57, the conveyor belt 43 locate in an image transferable position for the photosensitive drums 41a, 41b and 41c while the belt 43 is always located in the image transferable position for the photosensitive drum 42.

In FIG. 2A, the cam 63 is located in a clockwise rotated position after the cam 63 is rotated through 90° from the counterclockwise rotated position shown in FIG. 1A. At this time, the contact point of the cam 63 which contacts the cam engagement portion 61 is nearest to the support point 62, and the movable arm 55 is lowered by the cam 63 and located in an lower position. In the lower position, the movable arm 55 makes the conveyor belt 43 in an image untransferable position for the photosensitive drums 41a, 41b and 41c while the belt 43 is always located in the image transferable position for the photosensitive drum 42. In other words, the movable support roller 57 is moved downward as indicated by an arrow K in FIG. 2B as a result of the downward rotation of the movable arm 55, and is separated from the inner peripheral surface of the upper horizontally extending portion of the conveyor belt 43 to produce a clearance M between it and the upper horizontally extending portion of the belt 43. In this situation, the position of the driven roller 46 is not changed.

When the conveyor belt 43 is moved between the image transferable position for the other drums 41a, 41b and 41c as is shown in FIGS. 1A and 1B and the image untransferable position for the other drums as is shown in FIGS. 2A and 2B, the position of the driven roller 46 is not moved, but the shape of that section of the upper horizontally extending portion of the conveyor belt 43 which is located between the driven roller 46 and the stable support roller 56 is changed as follows.

That is, when the conveyor belt 43 is located in the image transferable position, as is shown in FIGS. 1A and 1B, an introduction section of the upper horizontally extending portion of the conveyor belt 43 which is located between the driven roller 46 and the movable support roller 57 is inclined upward from the driven roller 46 toward the movable support roller 57, and a part of the image forming section excluding the photosensitive drum 42 is located horizontally between the movable support roller 57 and the stable support roller 56 at the same level of a horizontal part of the upper horizontally extending portion of the conveyor belt 43 between the stable support roller 56 and the driving roller 47.

Further, when the conveyor belt 43 is located in the image untransferable position, as is shown in FIGS. 2A and 2B, all that section of the upper horizontally extending portion of the conveyor belt 43 which is located between the driven roller 46 and the stable support roller 56 is slightly inclined upward from the driven roller 46 toward the stable support roller 56 to cross the horizontal part of the upper horizontally extending portion of the conveyor belt 43 between the stable support roller 56 and the driving roller 47. Further, a press roller (an attachment assisting roller) 54 is arranged to oppose to the driven roller 46 and to press the same.

The press roller 54 is formed of conductive rubber and the driven roller 46 is formed of metal.

More specifically, the press roller 54 is arranged such that a line 58 (the one-dot chain line in FIG. 1B) passing the rotation center of the driven roller 46 and that of the press roller 54 is inclined to form an angle δ smaller than 90° relative to a sheet introduction section 43' (located between the movable support roller 57 and the driver roller 46) of the upper horizontally extending portion of the conveyor belt 43 when the conveyor belt 43 is located in the image transferable position. Since the press roller 54 is so arranged relative to the sheet introduction section 43', the paper sheet passing through a contact point between the press roller 54 and the driven roller 46 is pressed on the sheet introduction section 43' and is attached on the conveyor belt 43. A bias which will be described in detail is applied to the press roller 54. The press roller 54 assists the attraction of the paper sheet against the conveyor belt 43 by the bias and the above described pressing, and cooperates with the conveyor belt 43 to convey the sheet.

Figure 3:
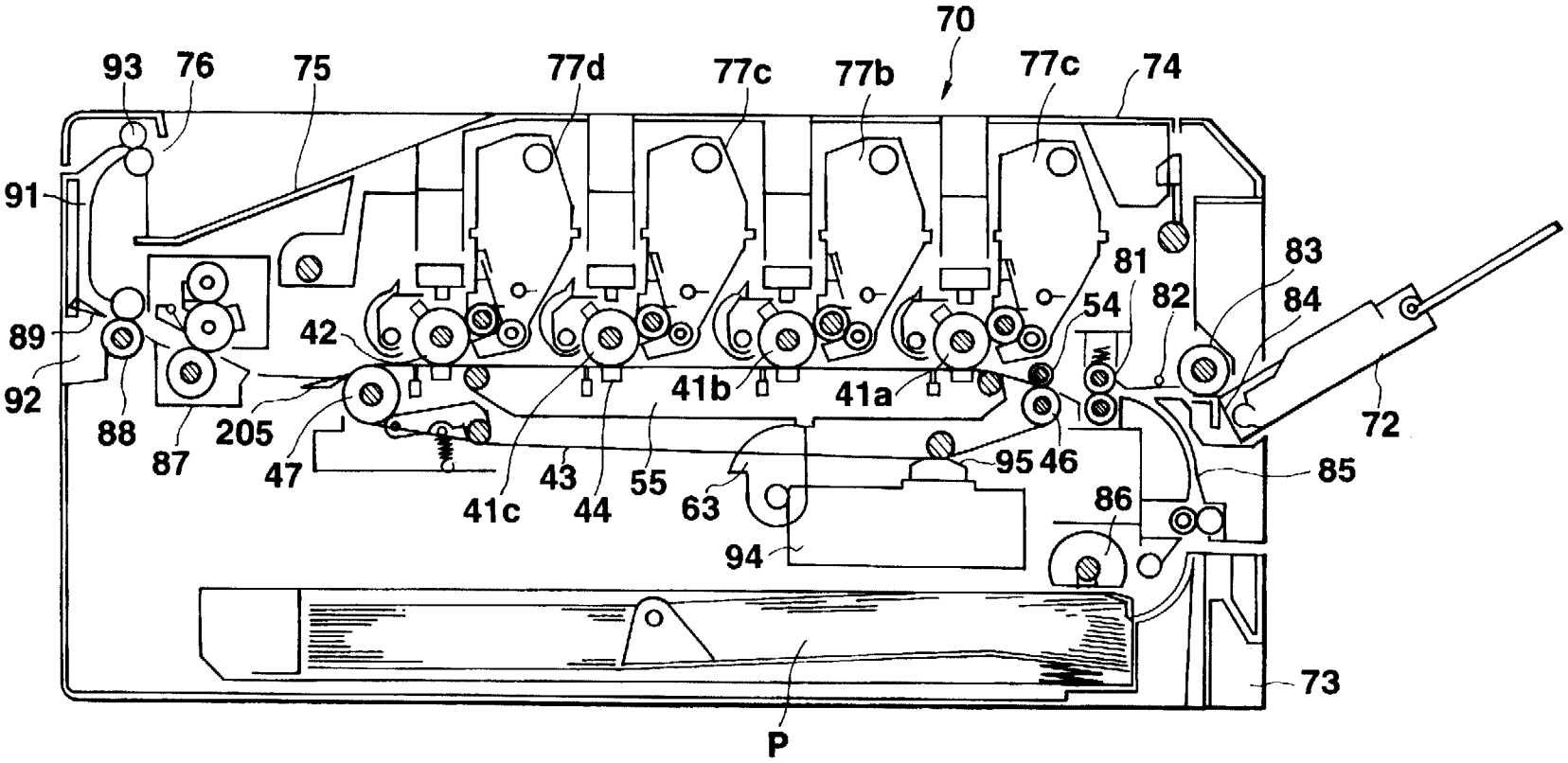
FIG. 3 is a longitudinal sectional view showing the internal structure of the image forming apparatus according to the embodiment.
Figure 7A:
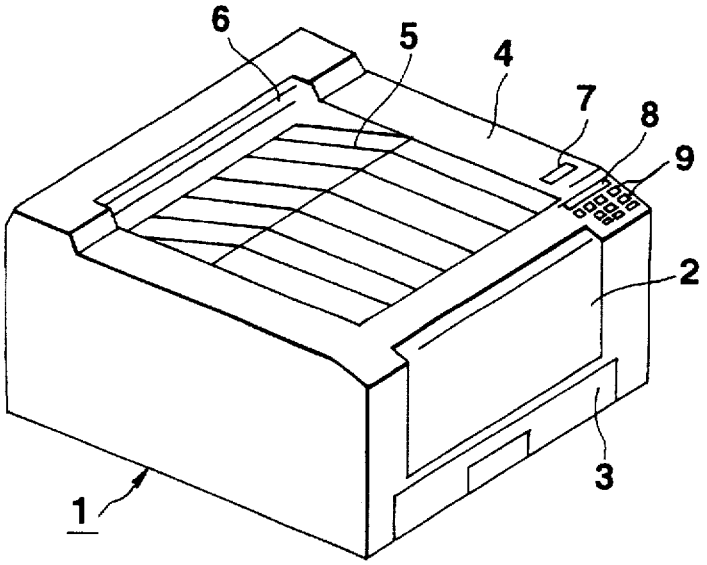
PRIOR ART FIG.7A
FIG. 7A is a schematic perspective view showing an outer appearance of a conventional tandem type color image forming apparatus.
Figure 7B:
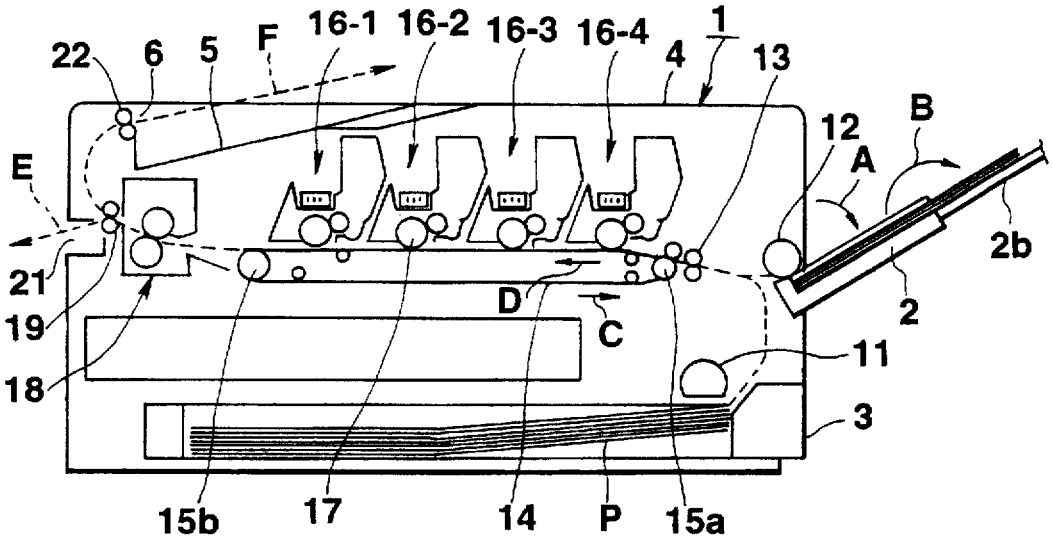
PRIOR ART FIG.7B
FIG. 7B is a longitudinal sectional side view of the conventional apparatus of FIG. 7A.
Figure 8A:
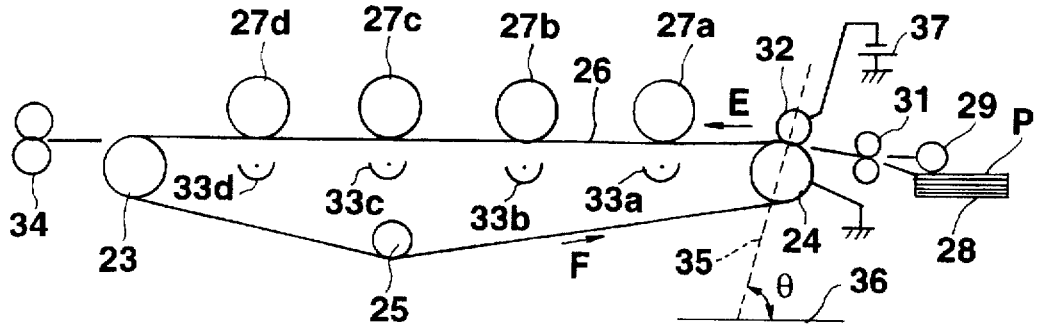
PRIOR ART FIG.8A
FIG. 8A is a schematical side view showing an image forming section of the conventional tandem type color image forming apparatus of FIG. 7A in a state for a full color printing.
Figure 8B:
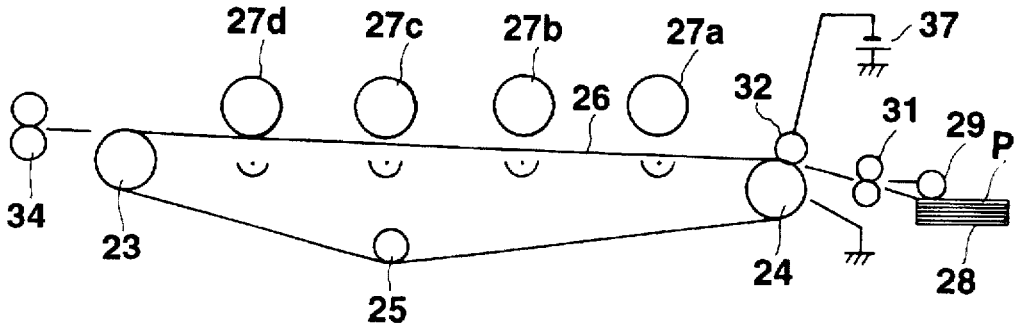
PRIOR ART FIG.8B
FIG. 8B is a schematical side view showing the image forming section of the conventional tandem type color image forming apparatus of FIG. 7A in a state for a monochrome printing.
Figure 8C:
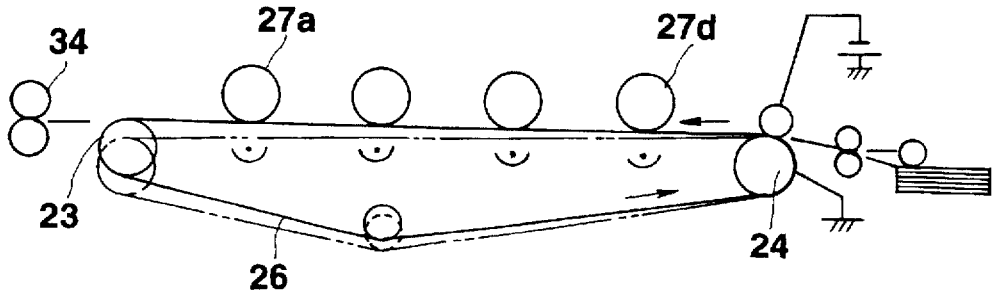
PRIOR ART FIG.8C
FIG. 8C is a schematical side view showing another image forming section of the conventional tandem type color image forming apparatus of FIG. 7A in both states for the full color printing and for the monochrome printing.
Figure 9A:
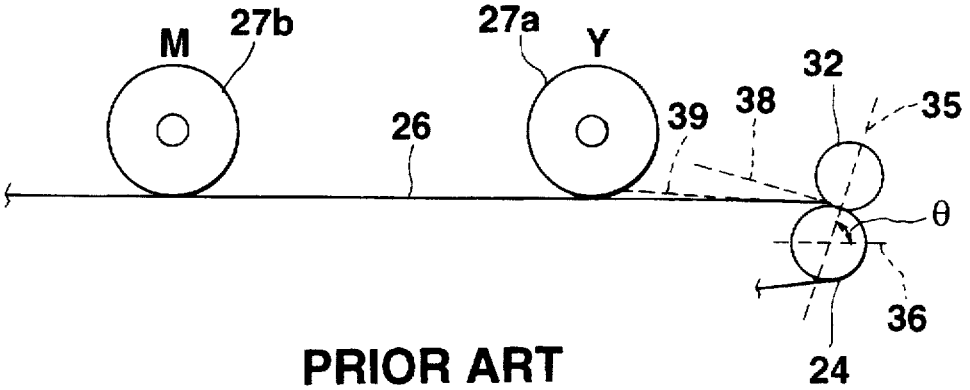
PRIOR ART FIG.9A
FIG. 9A is a schematical enlarged side view of a paper sheet introducing mechanism including a press roller, used in the image forming section of the conventional tandem type color image forming apparatus of FIG. 7A in a state for the color printing.
Figure 9B:
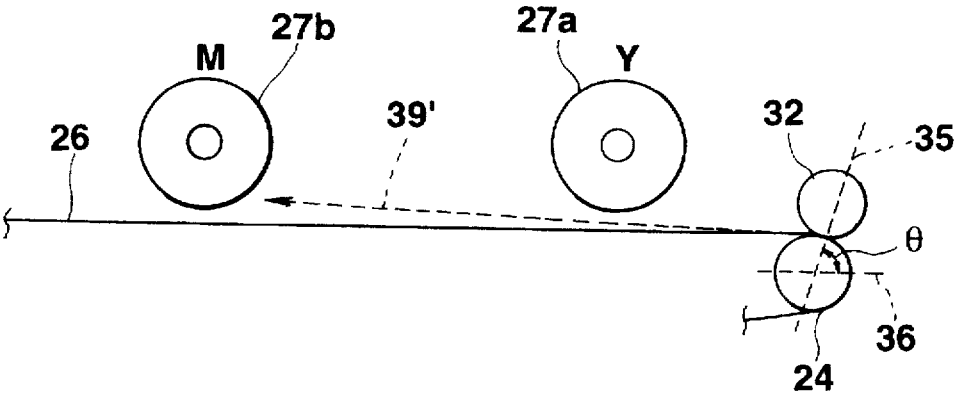
PRIOR ART FIG.9B
FIG. 9B is a schematical enlarged side view of the paper sheet introducing mechanism including the press roller, used in the image forming section of the conventional tandem type color image forming apparatus of FIG. 7A in a state for the monochrome printing.

FIG. 3 is a longitudinal sectional view showing an internal structure of the image forming apparatus according to the embodiment. The image forming apparatus 70 has substantially the same outer appearance as the conventional tandem type image forming apparatus shown in FIG. 7A. It comprises an openable tray 72 at a front surface (i.e., at the right end in the figure) of the apparatus, and a detachable sheet cassette 73 at the lower portion of the apparatus. A sheet discharge tray 75 is formed in an upper cover 74 of the apparatus 70, and an image-formed paper sheet is discharged from the apparatus 70 to the sheet discharge tray 75 through an upper sheet discharge port 76 formed in the upper tray 74. A power switch, a display device, a plurality of input keys, etc. (which are not shown) are located on a front end portion of the upper cover 74 at one side region thereof.

As is shown in FIG. 3, the image forming apparatus contains, at its substantially center portion, the aforementioned image forming section, i.e. the four photosensitive drums 41*a*, 41*b*, 41*c* and 42, the conveyor belt 43 opposed to the drums, the driven roller 46 and the driving roller 47 for stretching and driving the belt 43, the image transfer brushes 44*a*, 44*b*, 44*c* and 44*d* opposed to the photosensitive drums 41*a*, 41*b*, 41*c* and 42 with the conveyance belt 43 interposed therebetween, the movable arm 55 front portion (upstream side) of which is vertically swung by the cam 63, etc. Around each of the four photosensitive drums 41*a*, 41*b*, 41*c* and 42, elements incorporated in each of four image forming units 77*a*, 77*b*, 77*c* and 77*d*, which will be described later in more detail, are arranged.

On the upstream side (on the right side) of the overall image forming section with respect to the direction of sheet conveyance, a pair of standby rollers 81 and a sheet sensor 82 are provided. On the upstream side of the sensor 82, a sheet feed roller 83, a separation member 84 and the openable tray 72 are provided sideways. Moreover, on the upstream side of the sensor 82, a sheet conveyance passage constituted by two guide plates extends downward, and the aforementioned sheet cassette 73 which contains a lot of sheets P is located at the extending end of the sheet conveyance passage 85. A sheet feed roller 86 is provided above the sheet feed end of the cassette 73. On the downstream side of the image forming section with respect to the direction of sheet conveyance, there are provided a fixing unit 87, a sheet discharge roller pair 88 and a sheet discharge switching lever 89. The fixing unit 87 includes a press roller, a heating roller, a roller periphery cleaner, an oil-coating roller, a thermistor, etc., which are assembled in a thermally-insulated box case, and heats a toner image transferred to a paper sheet by the image forming section to fix the image thereon. The switching lever 89 guides the sheet to an upper sheet discharge passage 91 when it is positioned in a lower position as shown in FIG. 3, and to a side sheet discharge port 92 opening in a rear surface of the apparatus when it is positioned in an upper position. An upper end of the discharge passage 91 is connected to the upper sheet discharge port 76 via a pair of discharge rollers 93.

A cleaner bottle 94 is detachably provided between the image forming section and the sheet feed cassette 73. A blade scraper 95 is attached to an upper portion of the cleaner bottle 94 such that it contacts an outer surface of the lower horizontally extending portion of the loop of the conveyor belt 43. The blade scraper 95 scrapes toner remaining on the outer surface of the conveyor belt 43 to clean the same, and collects the scraped toner into the cleaner bottle 94.

Figure 4:
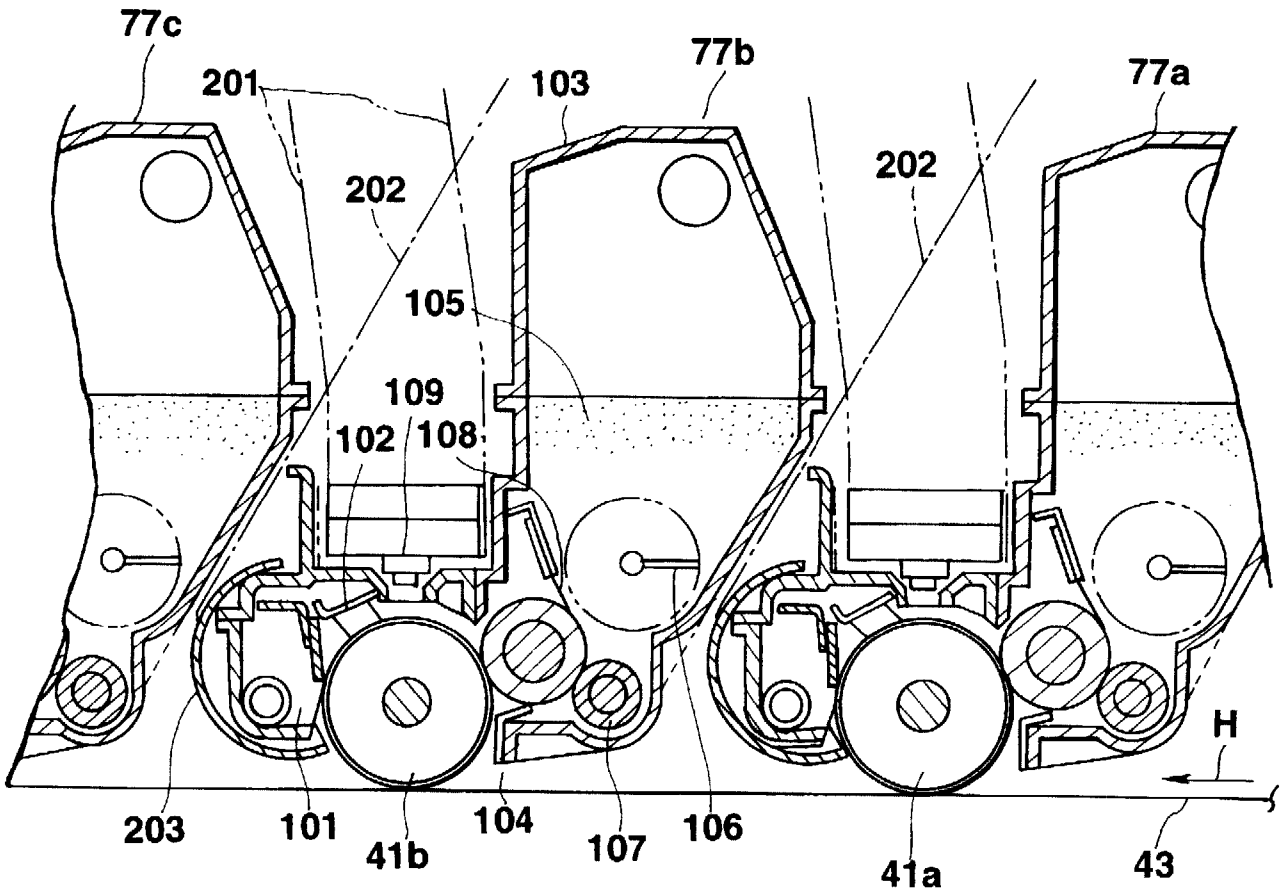
FIG. 4 is an enlarged longitudinal sectional view showing a part of image forming units incorporated in the image forming apparatus according to the embodiment of the invention.

FIG. 4 is an enlarged longitudinal sectional view showing a part of the image forming units 77*a*, 77*b*, 77*c* and 77*d*, which have the same structure as to each other but contain toners of different colors. With reference to FIG. 4, the structure of the image forming unit 77*b* will be described in detail. As is shown in FIG. 4, the image forming unit 77*b* includes a cleaner 101, a charger 102, and a developer (toner image forming means) 103. The developer 103 has a case, supports a developing roller 104 at an lower opening of the case, and contains toner 105. The developer 103 of the image forming unit 77*d* contains black toner, which corresponds to the photosensitive drum (the image carrier) 42 nearest to the driving roller (the second drive roller) 47 as is shown in FIG. 3. The developers 103 of the other image forming units 77*a*, 77*b* and 77*c* which correspond to the other photosensitive drums 41*a*, 41*b* and 44*c* contain yellow, magenta and cyanogen toners, respectively.

A toner stirring member 106 is provided in a lower portion of the developing unit 103. The stirring member 106 rotates as indicated by the two-dot chain line in FIG. 4 to stir toner and supply the same to a supply roller 107 located below the stirring member 106. The supply roller 107 is formed of a sponge, and is pressed on the developing roller 104 to rub toner 105 against the peripheral surface of the developing roller 104. A doctor blade 108 formed of a plate spring contacts the peripheral surface of the developing roller 104 and supplies frictional charge to the toner to increase the attachment force of the toner to the developing roller 104 and also to control the thickness of the attached toner to a constant value.

Each element incorporated in each of the image forming units 77*a*, 77*b*, 77*c* and 77*d* has a gear or electric terminals (not shown), and the gear or electric terminals is or are engaged with a driving mechanism or electric terminals of a power supply (not shown) incorporated in the apparatus body when each of the image forming units 77*a*, 77*b*, 77*c* and 77*d* is mounted in the predetermined position of the apparatus body.

Four exposure heads 109 for four image forming units 77*a*, 77*b*, 77*c* and 77*d* are fixed to the upper cover 74 shown in FIG. 3, and each of the exposure heads 109 is arranged in an image forming position between the charger 102 and the developing roller 104 of the each image forming unit 77*a*, 77*b*, 77*c* or 77*d* while the upper cover 74 is closed as shown in FIGS. 3 and 4. Each of the heads 109 is removed upward with arcuate locuses indicated by the two-dot chain lines 201 in FIG. 4 from the image forming position when the upper cover 74 is opened. After the upper cover 74 is opened and the exposure heads 109 are moved upward, each of the image forming units 77*a*, 77*b*, 77*c* or 77*d* can be taken out of the apparatus in an oblique direction extending upwardly and rightwardly and indicated by the two-dot chain line 202 in FIG. 4. When each of the image forming units 77*a*, 77*b*, 77*c* and 77*d* is taken out of the apparatus, a protection cover 203 is rotated clockwise and covers a corresponding photosensitive drum 41*a*, 41*b*, 41*c* or 42 to protect it.

Figure 5A:
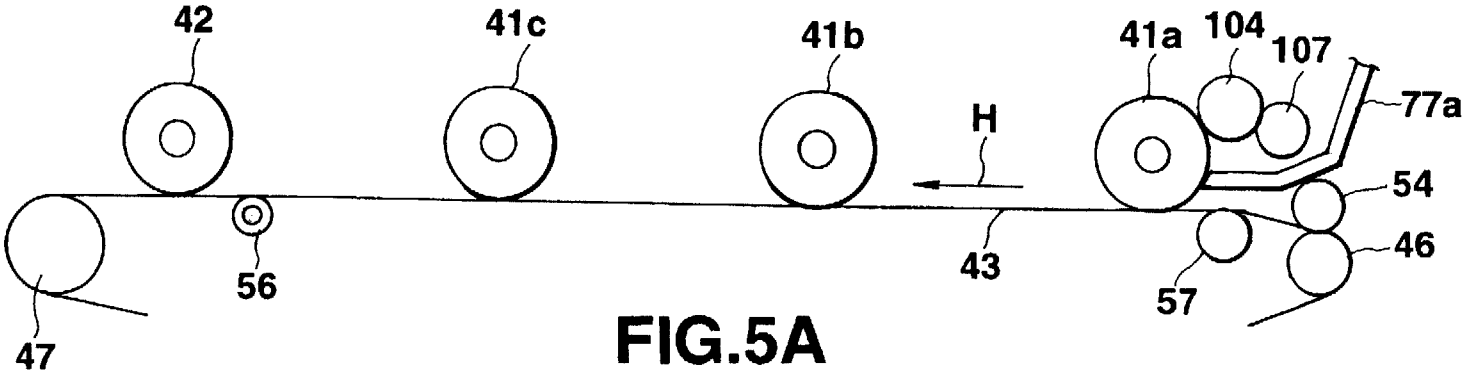
FIG. 5A is a schematic side view showing only those elements in FIG. 1A which relates to the conveyance of the paper sheet for the full color printing.
Figure 5B:
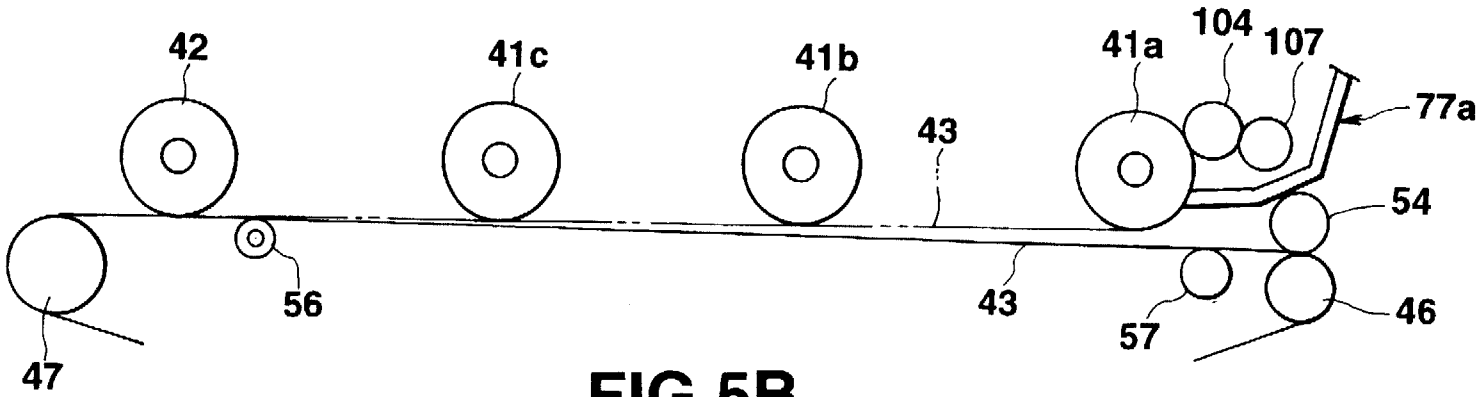
FIG. 5B is a schematic side view showing only those elements in FIG. 2A which relates to the conveyance of the paper sheet for the monochrome printing.

The image forming operation of the above-described image forming apparatus will now be described with reference to FIGS. 1A to 4 and also to FIGS. 5A and 5B. FIG. 5A schematically shows only those elements in FIG. 1A which relates to the conveyance of the paper sheet for the full color printing, and FIG. 5B schematically shows only those elements in FIG. 2A which relates to the conveyance of the paper sheet for the monochrome printing.

First, when the power switch (not shown) of the image forming apparatus 70 (see FIG. 3) is turned on, the number of sheets or other data for printing is input by the input keys on the top cover 74, and full color printing (image forming) is designated, the cam 63 is driven by a driving mechanism (not shown) to rotate counterclockwise through 90° from the monochrome printing setting position shown in FIG. 2A to the full color printing position shown in FIG. 1A, thereby rotating the movable arm 55 upward and hence moving the movable support roller 57 upward to bring the conveyor belt 43 into contact with all of the four photosensitive drums 41*a*, 41*b*, 41*c* and 42 (see FIG. 1A).

Subsequently, the sheet feed roller 86 feeds a sheet P from the sheet cassette 73 to the standby roller pair 81 through the sheet conveyance passage 85. Alternatively, the sheet feed roller 83 feeds a sheet P placed on the openable tray 72 to the standby roller pair 81. When the sheet P is sensed by the sheet sensor 82, the standby roller pair 81 stops its rotation to make a front end of the sheet P contact the contact point between the standby roller pair 81 and to wait the sheet for the printing.

Further, the driving roller 47 starts to rotate counterclockwise. As a result of this, the conveyor belt 43 is circulated counterclockwise to move its upper horizontally extending portion from right to left as indicated by the arrow H in FIG. 1A and to be brought into contact with the four photosensitive drums 41*a*, 41*b*, 41*c* and 42.

More further, the image forming units 77*a*, 77*b*, 77*c* and 77*d* are driven at their respective timing for printing, and accordingly the photosensitive drums 41*a*, 41*b*, 41*c* and 42 are sequentially rotated clockwise. Also, the exposure heads 109 in the driven image forming units 77*a*, 77*b*, 77*c* and 77*d* are sequentially driven. When the drums 41*a*, 41*b*, 41*c* and 42 are rotated as described above, the charger brushes 102 uniformly charge the peripheral surfaces of the photosensitive drums 41*a*, 41*b*, 41*c* and 42, and the exposure heads 109 expose on the peripheral surfaces of the drums in response to image signals supplied thereto, thereby forming electrostatic latent images on the drums. The developing rollers 104 transfer toner 105 to low potential portions (the electrostatic latent images) on the drums to form (develop) toner images on the drums, respectively.

The standby roller pair 81 starts its rotation to feed the sheet P to the image forming section, so that a print start position on the sheet P can reach a contact point of the photosensitive drum 41*a* located at the upstream end in the sheet conveyance direction H, at the contact point the drum 41*a* being brought into contact with the conveyor belt 43, when a leading end of the toner image on the photosensitive drum 41*a* in the rotational direction thereof has reached the contact point in accordance with the rotation of the drum. The press roller 54 and the driven roller 46 hold therebetween the sheet P, together with the conveyor belt 43. By virtue of the aforesaid particular arrangement of the press roller 54 with the angle δ smaller than 90° to the sheet introduction section 43' of the conveyor belt 43, the press roller 54 conveys the sheet P while pressing a leading end portion of the sheet P on the outer peripheral surface of the sheet introduction section 43' of the conveyor belt 43. Thus, the sheet P is conveyed by the press roller 54 and the driven roller 46 to the upstream end of first image transfer portion constituted by the photosensitive drum 41*a* and the image transfer brush 44*a* corresponding thereto, while the sheet P is nicely attached to the conveyor belt 43. At this time, the angle formed between the horizontal line and that section of the conveyor belt 43 which extends between the driven roller 46 and the movable support roller 57 (i.e. the sheet introduction section 43') is about 15°, and the sheet P can be conveyed to the first image transfer portion without any problem by the conveyor belt 43. Further, after passing the first image transfer portion, the sheet P can reliably be conveyed by the belt 43 to the next image transfer portion since the paper P is electrostatically attached to the belt 43 by an electric field generated in the first image transfer portion.

While the sheet P is conveyed as described above, toner images on the photosensitive drums 41*a*,41*b*,41*c* and 42 are sequentially transferred to the sheet P by electric fields generated between the image transfer brushes 44*a*, 44*b*, 44*c* and 44*d* and the photosensitive drums 41*a*, 41*b*, 41*c* and 42 as a result of application of a voltage from the brushes to the drums.

The sheet P on which the toner images of four colors have been transferred is separated from the conveyor belt 43 by a separation claw 205 (see FIG. 3), and is fed to the fixing unit 87. After the toner images on the sheet P are fixed thereon by heat fixing, the sheet P is discharged by the sheet discharge roller pair 88 to the outside of the apparatus through the rear sheet discharge port 92 with the toner images directed upward, or through the upper sheet discharge port 76 with the toner images directed downward.

The operation of the apparatus 70 for monochrome printing (image forming with black toner) will now be described. When, monochrome printing is designated after the full color printing is performed, the cam 63 is rotated clockwise through 90° from the full color printing position shown in FIG. 1A to the monochrome printing position shown in FIG. 2A, thereby downwardly moving the movable arm 55 with the movable support roller 57 and separating the photosensitive drums 41*a*, 41*b* and 41*c* from the inner peripheral surface of the upper horizontally extending portion of the conveyor belt 43. Thus, the conveyor belt 43 keeps in contact with the photosensitive drum 42 between the driving roller 47 and the stationary support roller 56 as in the full color printing, and is separated from the photosensitive drums 41*a*, 41*b* and 41*c* between the stationary support roller 56 and the driven roller 46.

Sheet feeding by the sheet feed roller 86 or 83, sheet sensing by the sheet sensor 82, sheet waiting by the sheet standby rollers 81, and circulation of the conveyor belt 43 by the driven and driving rollers 46 and 47 are performed in the same manners as in the case of the above described full color printing.

At the same time, only the image forming unit 77*d* is operated, and the other image forming units 77*a*, 77*b* and 77*c* are not operated. In the image forming unit 77*d*, the rotation of the photosensitive drum 42, charge of the drum 42 by the charger brush 102, formation of an electrostatic latent image on the drum 42 by the exposure head 109, and the development of the latent image by the developing roller 104, are the same as in the case of the full color printing.

The standby roller pair 81 starts its rotation to feed the sheet P to the image forming section, so that a print start position on the sheet P can reach a contact point of the photosensitive drum 42 being brought into contact with the conveyor belt 43, when a leading end of a black toner image on the drum 42 in the rotational direction thereof has reached the contact point in accordance with the rotation of the drum.

Also in this case, the press roller 54 and the driven roller 46 hold therebetween the sheet P, together with the conveyor belt 43. By virtue of the aforesaid arrangement of the press roller 54 with the angle δ smaller than 90° to the sheet introduction section 43' of the conveyor belt 43, the press roller 54 conveys the sheet P while pressing a leading end portion of the sheet P on the outer peripheral surface of the sheet introduction section 43' of the conveyor belt 43.

Thereafter, in the same manners as in the full color printing, the conveyance of the sheet P by the conveyor belt 43, transferring of a black toner image from the drum 42 to the sheet P by the image transfer brush 44*d*, separation of the sheet P from the conveyor belt 43 by the separation claw 205, heat fixing of the toner image on the sheet P by the fixing unit 87, and discharge of the sheet P from the apparatus 70 by the discharge roller pair 88 through the rear sheet discharge port 92 or the upper sheet discharge port 76.

Since the movable support roller 57 does not press the conveyor belt 43 upward, the upper horizontally extending portion of the conveyor belt 43 provides a slightly inclined flat surface between the stationary support roller 56 and the driven roller 46. As a result of this, the sheet P can be conveyed stably by the conveyor belt 43 over a relatively long distance between the driven roller 46 and the stationary support roller 56. Moreover, since the bend of the conveyor belt 43 produced at the stationary support roller 56 is very gentle, the leading end portion of the sheet P will not be separated from the conveyor belt 43 at the bend.

As described above, both in the full color printing and in the monochrome printing, only that portion of the conveyor belt 43 which extends between the stationary support roller 56 and the driven roller 46 swings vertically, and the attitude of that portion of the conveyor belt 43 which corresponds to the image transfer portion for monochrome printing is kept constant since the positions of the driving roller 47 and the stationary support roller 56 are not changed. In addition, the attitude of the sheet P fed from the contact point between the driven roller 46 and the press roller 54 to the image forming section is constant since the positions of the driven roller 46 and the press roller 54 are not changed. Further, the attitude of the sheet P discharged from the image forming section and introduced into the fixing unit 87 is kept constant since the positions of the photosensitive drum 42, the driving roller 47 and the stationary support roller 56 are not changed.

Since the attitude of the conveyor belt 43 relative to the image transfer portion for monochrome printing is kept constant, it is not necessary, both in the full color printing and in the monochrome printing, to change the image transfer timing in the image transfer portion for the black toner image, the voltage applied to the image transfer brush 44*d*, etc. In other words, the transfer of the black toner image from the drum 42 to the paper sheet P both in the full color printing and in the monochrome printing can be performed by the same control method. Also, since the position of the entrance (that is, the combination of the driven roller 46 and the press roller 54) of the image forming section is kept constant relative to the sheet feed section such as the sheet cassette 73, the standby roller pair 81, etc., it is not necessary to change the position of the sheet cassette 73 or the standby roller pair 81, in comparison with the conventional case, in accordance with a vertical change in the position of the entrance of the image forming section at the time of switching the printing mode between the full color printing and the monochrome printing. As a result, the structure of the apparatus can be made simple. Further, since the attitude of the sheet P discharged from the image forming section is kept constant, it is not necessary, both in the full color printing and in the monochrome printing, to change the guide path to the fixing unit in accordance with the attitude of the discharged sheet, which also enables the structure of the overall apparatus to be made simple.

Although in the above-described embodiment, the image forming unit 77*d* for black toner, i.e. the photosensitive drum 42 carrying a black toner image, is located at the downstream end of the sheet conveyance path in the image forming section, this invention is not limited to this, but may be modified such that the photosensitive drum 42 is located at the upstream end of the sheet conveyance path. In this case, the stationary support roller 56 and the movable support roller 57 are located at the upstream end of the sheet conveyance path and at the downstream end of the same, respectively, and accordingly the movable arm 55 is fixed its right end and is vertically swingable at its left end.

Although in this embodiment, the press roller 54 is a stationary roller, it may be modified such that the location of the press roller 54 relative to the driven roller 46 can be changed to change the inclination angle δ of the line passing through the rotational center of the press roller 54 and that of the driven roller 46, to that portion of the conveyor belt 43 between the driven roller 46 and the movable roller 57, between in the monochrome printing and in the full color printing and to set an appropriate sheet feed direction in each printing mode. For example, the inclination angle δ is set to the same value as in the above described embodiment at the time of the monochrome printing, and is set to a value slightly larger than the same value as in the above described embodiment at the time of the full color printing to make the angle between the leading end of the sheet P discharged from the contact point between the press roller 54 and the driven roller 46, and the sheet introduction section 43' of the conveyor belt 43, becomes gentle since the sheet introduction section 43' of the conveyor belt 43 is slightly inclined upward at the time of the full color printing.

The conveyor belt 43 must sufficiently electrostatically attract the paper sheet P to stably convey the sheet P, without the sheet P being influenced by even a little load applied thereto. To this end, the conveyor belt 43 has, as described above, a volume resistivity of $10^{11}$ Ωcm or more which enables the sheet P to be electrostatically attached to the belt 43. Moreover, the press roller 54 is arranged such that the line 58 passing through the rotational center of the press roller 54 and that of the driven roller 46 is inclined toward the sheet introduction section 43' of the belt 43 to facilitate the attachment of the sheet to the belt 43.

In the full color printing, there is no possible that the attitude of the sheet P will be changed by an external force while the sheet P is conveyed from the contact point between the press roller 54 and the driver roller 46 to the first image transfer portion for Yellow toner image because the distance from the contact point to the first image transfer portion is short, and the electrostatic force is applied from the first transfer brush 44*a* to the sheet P at the first image transfer portion is strong enough to sufficiently attach the sheet to the conveyor belt 43. Therefore, in the full color printing, the press roller 54 is needed only to control the attitude of the sheet P so that the sheet P is pressed on the conveyor belt 43 to assist the attachment of the sheet to the conveyor belt 43, and is not needed to control the attitude of the sheet P for any other purpose.

However, the image forming apparatus according to this invention has two printing modes one of which is the monochrome printing and the other of which is the full color printing. In the monochrome printing, since the distance from the contact point between the press roller 54 and the driven roller 46 to the image transfer portion for the black toner image is relatively long as shown in FIG. 2A, the attitude of the sheet P may become unstable while the sheet P is conveyed from the contact point to the image transfer portion for the black toner image. In the embodiment of the invention, at the time of monochrome printing, a bias for attaching the sheet P to the conveyor belt 43 is applied to the press roller 54 to more positively electrostatically attach the sheet P to the conveyor belt 43.

Figure 6:
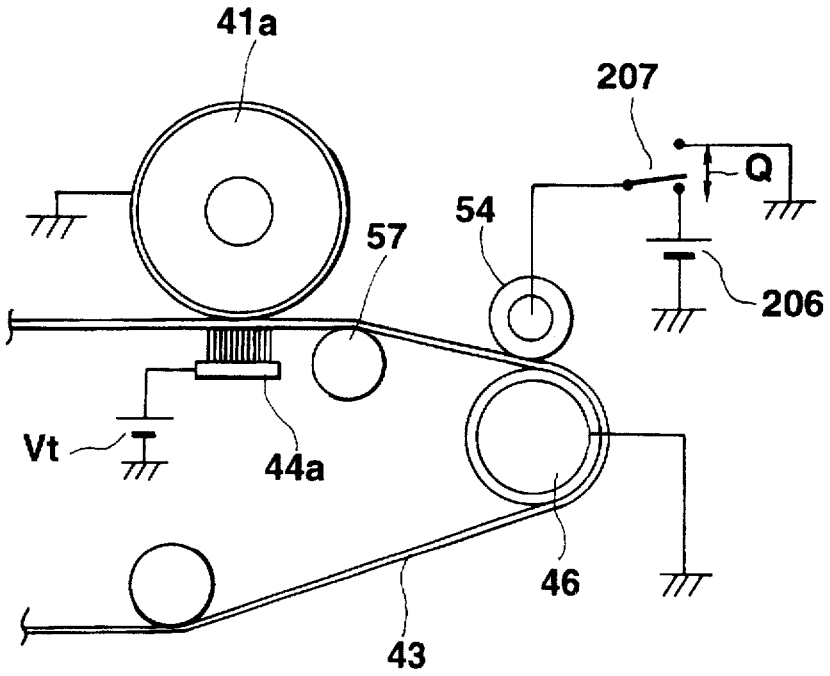
FIG. 6 is a schematic side view showing a structure for positively electrostatically attaching a paper sheet to the conveyor belt at a sheet introduction section of the conveyor belt.

FIG. 6 schematically shows a structure for positively electrostatically attaching the sheet P to the sheet introduction section of the conveyor belt 43. In FIG. 6, elements similar to those in FIGS. 1A to 5B are denoted by the same reference numerals as those used to denote those elements in FIGS. 1A to 5B. The driven roller 46 in FIG. 6 is formed of a grounded metallic roller, and the press roller 54 is formed of a rubber roller the resistivity of which is adjusted by carbon black. For example, the press roller 54 is made of CR rubber which will show a resistivity of $10^6$Q when a voltage of 500V is applied to the surface of the press roller 54 and its shaft. For example, +2.0 KV as a voltage having the same positive polarity as that of a voltage Vt applied to each of the image transfer brushes (44*a*, 44*b*, 44*c* and 44*d* in FIGS. 1A and 2A) is applied to the press roller 54 from a bias supply source 206. By this bias, the sheet P can be positively electrostatically attached to the conveyor belt 43, and can be conveyed without positional defection over the relatively long distance from the contact position between the press roller 54 and the driven roller 46 to the image transfer portion for black toner image located at the downstream end of the paper conveyance passage in the image forming section.

The reason why the polarity of the bias applied to the press roller 54 is set identical to that of a voltage applied to each of the transfer brushes 44*a*, 44*b*, 44*c* and 44*d* will be explained.

When a leading end of the sheet P is reached at the first image transfer position (that is, an opposing position at which the first photosensitive drum 41*a* and the first image transfer brush 44*a* are opposed to each other with the conveyor belt 43 interposed there between), the sheet P is held by the press roller 54 and the driven roller 46. And, the sheet P has a sufficiently high resistivity under usual circumstances or low-humidity circumstances. However, under high-humidity circumstances, the resistivity of the sheet is reduced since it absorbs moisture. Accordingly, if an electric field applied to the sheet P becomes large, a current will flow there through. Further, if the bias applied to the press roller 54 has a polarity opposite to that of the voltage applied to each of the image transfer brushes 44*a*, 44*b*, 44*c* and 44*d*, the current flowing to each of the transfer brushes 44*a*, 44*b*, 44*c* and 44*d* by an electric power source will leak to the bias supply source via the sheet P, since the absolute value of the potential difference between the image transfer position and the paper attraction position at the press roller 54 is equal to the sum of the voltages applied to the corresponding image transfer brush 44*a*, 44*b*, 44*c* or 44*d* and the press roller 54. As a result of this, an electric field necessary for image transfer cannot be generated, and hence the toner image formed on the corresponding photosensitive drum 41*a*, 41*b*, 41*c* or 41*d* cannot be transferred to the sheet P.

In the structure of FIG. 6, in order to avoid the above described problem, the polarity of the bias applied to the press roller 54 is set identical to that of the image transfer voltage applied to each of the transfer brushes 44*a*, 44*b*, 44*c* and 44*d*. Preferably, if the value of the bias is substantially the same as that of the voltage Vt of the electric power supply for the image transfer, no voltage difference will occur, and accordingly no current will leak. As a result of this, the attitude of the sheet P can not be defected while the sheet P is conveyed so that the toner images can be transferred well from the toner image transfer portions to the sheet P.

As described above, since the conveyor belt 43 has a volume resistivity of $10^{11}$–$10^{14}$ Ωcm, a combination of a grounded conductive roller (driven roller 46) and a conductive roller (press roller 54) supplied with a voltage is used as means for attracting an image transfer medium (a paper sheet P), and a voltage of the same polarity as that of a voltage applied to each image transfer brush 44*a*, 44*b*, 44*c* or 44*d* is applied to the sheet-attachment surface of the conveyor belt 43 by the press roller 54, the stable conveyance of the image transfer medium can be realized by a small electric power supply and a simple mechanism, and excellent image transfer can be realized without generation of ozone, irrespective of variations in circumstances from low humidity circumstances to high humidity circumstances.

Since as described above, it is not necessary, at the time of full color printing, to particularly assist the sheet attachment, as shown in FIG. 6. A switch 207 is provided between the press roller 54 and the bias supply source 206, and an input terminal end of the switch 207 is structured to be switched to connect the press roller 54 to one of a ground terminal and the bias supply source 206. The input terminal end of the switch 207 is switched to connect the press roller 54 to the ground terminal at the time of full color printing, and to the bias supply source 206 at the time of monochrome printing. This structure decreases the load of the electric power supply in comparison with the case of the structure wherein the bias is always applied, and hence can provide a conveyance mechanism of power-saving type capable of always performing stable attraction of sheets.

As described above, since the press roller is so arranged to the conveyor belt that a paper sheet can be securely pressed on the belt, the sheet can be conveyed stably by the conveyor belt both in full color printing and in monochrome printing. As a result of this, the attitude of the sheet is always stabilized while it is conveyed, and accordingly an image can be transferred in excellent quality to the sheet. Further, the frequency of occurrence of disadvantages such as sheet jam, etc. is reduced, thereby increasing the efficiency of image forming operation. Also, since the attitude of the conveyor belt with respect to the image transfer portion for the black image is kept constant, it is not necessary to change, between the full color printing mode and the monochrome printing mode, the image transfer timing in the image transfer portion for the black image, and the manner of control of a voltage applied to the image transfer units (in other words, the full color printing and the monochrome printing can be performed under the same control). Accordingly, the structure of the apparatus and the control mechanism thereof can be easily designed to contribute to lower the manufacturing cost of the apparatus. Moreover, since the path of the sheet from the sheet feed section to the image forming section is kept constant in the both printing modes, it is not necessary to change the position of the sheet cassette, the standby roller pair or the conveyance path between both the printing modes, so that the apparatus can be made simple in structure and compact. In addition, since the attitude of the sheet discharged from the image forming section is kept constant between both the printing modes, it is not necessary to change the sheet conveyance path from the image forming section to the fixing unit between both the printing modes, so that the apparatus can be made more simple in structure and more compact, thereby reducing the manufacturing cost of the apparatus. Furthermore, since the conveyor belt has a volume resistivity of $10^{11}$ to $10^{14}$ Ωcm, and a voltage of a polarity identical to that of the voltage applied to each of the image transfer brushes is applied for attraction of a sheet on the conveyor belt in the sheet introduction section, an electric current for image transfer is prevented from leaking to the bias supply source. This enables image transfer with a small current, and a compact image forming apparatus free from occurrence of ozone and hence suitable to environmental conservation can be realized.

Additional advantages and modifications will readily occur to those skilled in the art. Therefore, the invention in its broader aspects is not limited to the specific details, representative embodiments shown and described herein. Accordingly, various modifications may be made without departing from the spirit or scope of the general inventive concept as defined by the appended claims and their equivalents.

What is claimed is:

1. An image forming apparatus for forming an image on an image recording medium supplied from an image recording medium supply unit, said apparatus comprising:

first and second rollers arranged separate from each other, at least one of the first and second rollers being supplied with a rotation force;

a conveyor belt stretched between the first and second rollers for attracting the image recording medium supplied from the image recording medium supply unit onto an outer surface of a conveying portion of the conveyor belt between the first and second rollers, said conveyor belt being circulated by the first and second rollers to convey the image recording medium from one of the first and second rollers toward the other of the first and second rollers, such that: (i) the first roller is positioned at an upstream end of the outer surface of the conveying portion of the conveyor belt in a moving direction of the outer surface of the conveying portion of the conveyor belt, (ii) the second roller is positioned at a downstream end of the outer surface of the conveying portion of the conveyor belt in the moving direction, and (iii) the image recording medium is introduced onto the outer surface of the conveying portion of the conveyor belt at the upstream end thereof;

plurality of image carriers arranged side by side along the outer surface of the conveying portion of the conveyor belt, at least one of the image carriers being in contact with the image recording medium on the outer surface of the conveying portion of the conveyor belt;

a plurality of toner image forming devices for forming toner images of respective predetermined different colors on the image carriers;

a plurality of image transfer devices arranged in a space encircled by the conveyor belt such that the plurality of transfer devices are opposite to the plurality of image carriers with the conveying portion of the conveyor belt being interposed therebetween, wherein at least one of the image transfer devices which is opposite to the at least one of the image carriers which is in contact with the image recording medium is applied with an image transfer bias to transfer a given toner image from the at least one of the image carriers to the image recording medium; and an attraction assisting roller arranged to press the conveyor belt on the first roller so that the conveyor belt, together with the image recording medium supplied to the upstream end of the outer surface of the conveying portion of the conveyor belt, is pinched by the attraction assisting roller and the first roller, so that the image recording medium is assisted to be attracted onto the outer surface of the conveying portion of the conveyor belt, wherein the attraction assisting roller has a positional relationship with respect to the first roller and the outer surface of the conveying portion of the conveyor belt such that a line passing a rotation center of the attraction assisting roller and a rotation center of the first roller intersects at an angle of less than 90° with a line extending along a direction in which the outer surface of the conveying portion of the conveyor belt extends from a conveyor belt pinch point at which the attraction assisting roller and the first roller pinch the conveyor belt.

2. An image forming apparatus according to claim 1, further comprising an attraction bias application mechanism for applying an attraction bias on the attraction assisting roller.

3. An image forming apparatus according to claim 2, wherein the attraction bias application mechanism applies to the attraction assisting roller a voltage of a same polarity as a predetermined polarity of the image transfer bias.

4. An image forming apparatus according to claim 3, wherein the at least one of the image carriers which is in contact with the image recording medium on the outer surface of the conveying portion of the conveyor belt is located nearer to the second roller than the other image carriers, and wherein the image forming apparatus further comprises:

a belt moving mechanism for moving the conveyor belt between a mono-color image transfer position wherein the conveyor belt is in contact with the image carrier nearer to the second roller and a full-color image transfer position wherein the conveyor belt is in contact with all of the image carriers, wherein the belt moving mechanism maintains a position of the image recording medium constant relative to the image carrier nearer to the second roller when the image recording medium on the outer surface of the conveying portion of the conveyor belt arrives at the image carrier nearer to the second roller and while the conveyor belt is in the mono-color image transfer position and the full-color image transfer position; and a belt movement controller for controlling an operation of the belt moving mechanism to selectively move the conveyor belt between the mono-color image transfer position and the full-color image transfer position, wherein a range of the movement of the conveyor belt between the mono-color image transfer position and the full-color image transfer position is so set that the positional relationship of the attraction assisting roller with respect to the first roller and the outer surface of the conveying portion of the conveyor belt is maintained while the conveyor belt is in the mono-color image transfer position and the full-color image transfer position.

5. An image forming apparatus according to claim 4, wherein the attraction bias application device applies the attraction bias to the attraction assisting roller when the belt moving mechanism moves the conveyor belt to the mono-color image transfer position.

6. An image forming apparatus according to claim 4, wherein the one of the toner image forming devices corresponding to the image carrier nearer to the second roller forms a black toner image, and the other toner image forming devices corresponding to the other image carriers form color toner images other than black.

7. An image forming apparatus according to claim 2, wherein the at least one of the image carriers which is in contact with the image recording medium on the outer surface of the conveying portion of the conveyor belt is located nearer to the second roller than the other image carriers, and wherein the image forming apparatus further comprises:

a belt moving mechanism for moving the conveyor belt between a mono-color image transfer position wherein the conveyor belt is in contact with the image carrier nearer to the second roller and a full-color image transfer position wherein the conveyor belt is in contact with all of the image carriers, wherein the belt moving mechanism maintains a position of the image recording medium constant relative to the image carrier nearer to the second roller when the image recording medium on the outer surface of the conveying portion of the conveyor belt arrives at the image carrier nearer to the second roller and while the conveyor belt is in the mono-color image transfer position and the full-color image transfer position; and a belt movement controller for controlling an operation of the belt moving mechanism to selectively move the conveyor belt between the mono-color image transfer position and the full-color image transfer position, wherein a range of the movement of the conveyor belt between the mono-color image transfer position and the full-color image transfer position is so set that the positional relationship of the attraction assisting roller with respect to the first roller and the outer surface of the conveying portion of the conveyor belt is maintained while the conveyor belt is in the mono-color image transfer position and the full-color image transfer position.

8. An image forming apparatus according to claim 7, wherein the one of the toner image forming devices corresponding to the image carrier nearer to the second roller forms a black toner image, and the other toner image forming devices corresponding to the other image carriers form color toner images other than black.

9. An image forming apparatus according to claim 1, wherein the at least one of the image carriers which is in contact with the image recording medium on the outer surface of the conveying portion of the conveyor belt is located nearer to the second roller than the other image carriers, and wherein the image forming apparatus further comprises:

a belt moving mechanism for moving the conveyor belt between a mono-color image transfer position wherein the conveyor belt is in contact with the image carrier nearer to the second roller and a full-color image transfer position wherein the conveyor belt is in contact with all of the image carriers, wherein the belt moving mechanism maintains a position of the image recording medium constant relative to the image carrier nearer to the second roller when the image recording medium on the outer surface of the conveying portion of the conveyor belt arrives at the image carrier nearer to the second roller and while the conveyor belt is in the mono-color image transfer position and the full-color image transfer position; and a belt movement controller for controlling an operation of the belt moving mechanism to selectively move the conveyor belt between the mono-color image transfer position and the full-color image transfer position, wherein a range of the movement of the conveyor belt between the mono-color image transfer position and the full-color image transfer position is so set that the positional relationship of the attraction assisting roller with respect to the first roller and the outer surface of the conveying portion of the conveyor belt is maintained while the conveyor belt is in the mono-color image transfer position and the full-color image transfer position.

10. An image forming apparatus according to claim 9, wherein the one of the toner image forming devices corresponding to the image carrier nearer to the second roller forms a black toner image, and the other toner image forming devices corresponding to the other image carriers form color toner images other than black.

11. An image forming apparatus for forming an image on an image recording medium supplied from an image recording medium supply unit, comprising:

first and second rollers arranged separate from each other, at least one of the first and second rollers being supplied with a rotation force;

a conveyor belt stretched between the first and second rollers for attracting the image recording medium supplied from the image recording medium supply unit onto an outer surface of a conveying portion of the conveyor belt between the first and second rollers, said conveyor belt being circulated by the first and second rollers to convey the image recording medium from one of the first and second rollers toward the other of the first and second rollers, such that: (i) the first roller is positioned at an upstream end of the outer surface of the conveying portion of the conveyor belt in a moving direction of the outer surface of the conveying portion of the conveyor belt, (ii) the second roller is positioned at a downstream end of the outer surface of the conveying portion of the conveyor belt in the moving direction, and (iii) the image recording medium is introduced onto the outer surface of the conveying portion of the conveyor belt at the upstream end thereof;

a plurality of image carriers arranged side by side along the outer surface of the conveying portion of the conveyor belt, wherein at least one of the image carriers, including the one of the image carriers located nearer to the second roller than the other image carriers, is in contact with the image recording medium on the outer surface of the conveying portion of the conveyor belt;

a plurality of toner image forming devices for forming toner images of respective predetermined different colors on the image carriers;

a plurality of image transfer devices arranged in a space encircled by the conveyor belt such that the plurality of transfer devices are opposite to the plurality of image carriers with the conveying portion of the conveyor belt being interposed therebetween, wherein at least one of the image transfer devices which is opposite to the at least one of the image carriers which is in contact with the image recording medium transfers a given toner image from the at least one of the image carriers to the image recording medium;

a belt moving mechanism for moving the conveyor belt between a mono-color image transfer position wherein the conveyor belt is in contact with the image carrier nearer to the second roller and a full-color image transfer position wherein the conveyor belt is in contact with all of the image carriers, wherein the belt moving mechanism includes: (i) a stationary support roller which is arranged in the space encircled by the conveyor belt between the image transfer device opposite to the image carrier nearer to the second roller and the image transfer device opposite to the one of the image carriers next nearer to the second roller, said stationary support roller always contacting an inner surface of the conveying portion of the conveyor belt to maintain a position of the image recording medium constant relative to the image carrier nearer to the second roller when the image recording medium on the outer surface of the conveying portion of the conveyor belt arrives at the image carrier nearer to the second roller and while the conveyor belt is in the mono-color image transfer position and the full-color image transfer position, and (ii) a swing member which is swingable on a rotational axis of the stationary support roller to move the conveyor belt selectively to one or both of the mono-color image transfer position and the full-color image transfer position; and a belt movement controller for controlling the swing movement of the swing member.

12. An image forming apparatus according to claim 11, wherein the swing member includes a movable support roller arranged in the space encircled by the conveyor belt between the first roller and the one of the image transfer devices which is located nearer to the first roller, said movable support roller being moved to intersect the inner surface of the conveying portion of the conveyor belt by the swing movement of the swing member, whereby the movable support roller moves the conveyor belt between the mono-color image transfer position and the full-color image transfer position.

13. An image forming apparatus according to claim 11, wherein the swing member supports the image transfer devices other than the image transfer device nearer to the second roller so as to move the other image transfer devices by the swing movement of the swing member.

14. An image forming apparatus according to claim 11, further comprising a roller support mechanism for supporting the first and second rollers to fix the first and second rollers to the apparatus and to fix a positional relationship between the first roller and the image recording medium supply unit.

15. An image forming apparatus according to claim 11, wherein the one of the toner image forming devices corresponding to the image carrier nearer to the second roller forms a black toner image, and the other toner image forming devices corresponding to the other image carriers form color toner images other than black.

16. An image forming apparatus for forming an image on an image recording medium supplied from an image recording medium supply unit, comprising:

first and second rollers arranged separate from each other, at least one of the first and second rollers being supplied with a rotation force;

a conveyor belt stretched between the first and second rollers for attracting the image recording medium supplied from the image recording medium supply unit onto an outer surface of a conveying portion of the conveyor belt between the first and second rollers, said conveyor belt being circulated by the first and second rollers to convey the image recording medium from one of the first and second rollers toward the other of the first and second rollers, such that: (i) the first roller is positioned at an upstream end of the outer surface of the conveying portion of the conveyor belt in a moving direction of the outer surface of the conveying portion of the conveyor belt, (ii) the second roller is positioned at a downstream end of the outer surface of the conveying portion of the conveyor belt in the moving direction, and (iii) the image recording medium is introduced onto the outer surface of the conveying portion of the conveyor belt at the upstream end thereof;

a plurality of image carriers arranged side by side along the outer surface of the conveying portion of the conveyor belt, wherein at least one of the image carriers, including the one of the image carriers located nearer to the second roller than the other image carriers, is in contact with the image recording medium on the outer surface of the conveying portion of the conveyor belt;

a plurality of toner image forming devices for forming toner images of respective predetermined different colors on the image carriers;

a plurality of image transfer devices arranged in a space encircled by the conveyor belt such that the plurality of transfer devices are opposite to the plurality of image carriers with the conveying portion of the conveyor belt being interposed therebetween, wherein at least one of the image transfer devices which is opposite to the at least one of the image carriers which is in contact with the image recording medium transfers a given toner image from the at least one of the image carriers to the image recording medium;

a roller support mechanism for supporting the first and second rollers to fix the first and second rollers to the apparatus and to fix a positional relationship between the first roller and the image recording medium supply unit;

a belt moving mechanism for moving the conveyor belt between a mono-color image transfer position wherein the conveyor belt is in contact with the image carrier nearer to the second roller and a full-color image transfer position wherein the conveyor belt is in contact with all of the image carriers, wherein the belt moving mechanism maintains a position of the image recording medium constant relative to the image carrier nearer to the second roller when the image recording medium on the outer surface of the conveying portion of the conveyor belt arrives at the image carrier nearer to the second roller and while the conveyor belt is in the mono-color image transfer position and the full-color image transfer position; and a belt movement controller for controlling an operation of the belt moving mechanism to selectively move the conveyor belt between the mono-color image transfer position and the full-color image transfer position.

17. An image forming apparatus according to claim 16, further comprising:

a stationary support roller which is arranged in the space encircled by the conveyor belt between the image transfer device opposite to the image carrier nearer to the second roller and the image transfer device opposite to the one of the image carriers next nearer to the second roller, said stationary support roller always contacting an inner surface of the conveying portion of the conveyor belt to maintain a position of the image recording medium constant relative to the image carrier nearer to the second roller when the image recording medium on the outer surface of the conveying portion of the conveyor belt arrives at the image carrier nearer to the second roller and while the conveyor belt is in the mono-color image transfer position and the full-color image transfer position; and a swing member which is swingable on a rotational axis of the stationary support roller to move the conveyor belt selectively to one or both of the mono-color image transfer position and the full-color image transfer position.

* * * * *

UNITED STATES PATENT AND TRADEMARK OFFICE

CERTIFICATE OF CORRECTION

PATENT NO. : 5,765,082

DATED : June 9, 1998

INVENTOR(S) : NUMAZU et al.

It is certified that error appears in the above-identified patent and that said Letters Patent is hereby corrected as shown below:

Title page, Item [73] Assignee, add:

--and Casio Electronics Manufacturing Co.
Tokyo, Japan--.

Signed and Sealed this

Twenty-seventh Day of July, 1999

*Attest:*

Q. TODD DICKINSON

*Attesting Officer*

*Acting Commissioner of Patents and Trademarks*